US012011804B1

(12) United States Patent
Irving et al.

(10) Patent No.: US 12,011,804 B1
(45) Date of Patent: Jun. 18, 2024

(54) VACUUM DUST SHROUD SYSTEM AND METHODS

(71) Applicant: Tile Ram IP Holdings, LLC, Alpine, UT (US)

(72) Inventors: Bryan Irving, Alpine, UT (US); Christopher Reed, Salem, UT (US)

(73) Assignee: Tile Ram IP Holdings, LLC, Alpine, UT (US)

( * ) Notice: Subject to any disclaimer, the term of this patent is extended or adjusted under 35 U.S.C. 154(b) by 0 days.

(21) Appl. No.: 18/229,668

(22) Filed: Aug. 2, 2023

(51) Int. Cl.
*B24B 55/10* (2006.01)

(52) U.S. Cl.
CPC ..... *B24B 55/10* (2013.01)

(58) Field of Classification Search
CPC ..... B24B 55/06; B24B 55/10; B24B 55/102; B24B 23/02; B24B 23/028; B24B 23/04
See application file for complete search history.

(56) References Cited

U.S. PATENT DOCUMENTS 2,819,570 A * 1/1958 Tocci-Guilbert ..... B24B 55/05 451/451
3,987,589 A * 10/1976 Marton ..... B24B 55/102 15/385
4,145,848 A * 3/1979 Hutchins ..... B24B 55/102 451/359
5,125,190 A * 6/1992 Buser ..... B24B 55/102 451/359
8,793,835 B2 8/2014 King, Jr.
D882,367 S 4/2020 King, Jr.
D883,057 S 5/2020 King, Jr.
D906,078 S 12/2020 King, Jr.
D906,079 S 12/2020 King, Jr.
11,383,339 B2 7/2022 King, Jr.
2009/0181604 A1* 7/2009 Loveless ..... B24B 55/052 451/451
2012/0260458 A1 10/2012 King, Jr.
2013/0198996 A1 8/2013 King, Jr.
2014/0352106 A1 12/2014 King, Jr.
2016/0184963 A1* 6/2016 Melancon ..... B24B 55/102 55/307
2019/0249452 A1 8/2019 King, Jr.
2019/0321940 A1 10/2019 King, Jr.

* cited by examiner

*Primary Examiner* — Joel D Crandall
(74) *Attorney, Agent, or Firm* — Dentons Durham Jones Pinegar; Sarah W. Matthews; Lilly Godfrey

(57) ABSTRACT

A vacuum shroud system can include a shroud body having a top surface and a bottom surface, with a plurality of air holes defined by the shroud body and extending from the top surface to the bottom surface. A vacuum attachment void and a grinder attachment void may be defined by the shroud body, each extending from the top surface to the bottom surface. The vacuum shroud system may also include an adjustable collar disposed over the grinder attachment void of the shroud body to attach a grinder to the shroud body. The system may include a cover securable to the top surface of the shroud body, where the cover overhangs a top edge of the top surface. A vacuum hose may be securable within the vacuum attachment void, with a wall of the vacuum attachment void determining an outlet angle for the vacuum hose.

8 Claims, 20 Drawing Sheets

VACUUM DUST SHROUD SYSTEM AND METHODS

TECHNICAL FIELD

This disclosure relates generally to shrouds having grinder and vacuum hose attachments and to the shielding of debris that might escape through air intake openings in a vacuum shroud during the use of power tools to, for example, remove tiles.

SUMMARY

Disclosed are systems, devices, and/or methods of use thereof regarding shrouds having grinder and vacuum hose attachments. In various aspects, a vacuum shroud system can include a shroud body having a top surface and a bottom surface. The shroud body may include a plurality of air holes defined by the shroud body and extending from the top surface to the bottom surface, a vacuum attachment void defined by the shroud body and extending from the top surface to the bottom surface, and a grinder attachment void defined by the shroud body and extending from the top surface to the bottom surface. The vacuum shroud system may also include an adjustable collar comprising a first half and a second half, the adjustable collar disposed over the grinder attachment void of the shroud body. Additionally, the system may include a cover securable to the top surface of the shroud body, where the cover overhangs a top edge of the top surface to protect the plurality of air holes. The system may further include a vacuum hose securable within the vacuum attachment void, with a wall of the vacuum attachment void determining an outlet angle for the vacuum hose, and a grinder securable within the grinder attachment void through the adjustable collar.

In other aspects, a vacuum shroud may include a shroud body and a vacuum attachment void for receiving a vacuum hose. The vacuum attachment void may be defined by a vacuum wall and the shroud body, with the vacuum wall and the vacuum attachment void extending from a top surface to a bottom surface of the shroud body. In some embodiments, the vacuum wall extends from the top surface to the bottom surface of the shroud body at an angle of less than about 90°, such that a flow of air through the vacuum attachment void is not required to make a 90° turn as the air flows from the bottom surface of the shroud body through the vacuum attachment void and into the vacuum hose.

In some embodiments, a vacuum shroud may include a shroud body having a top piece and a bottom piece, where a bottom surface of the bottom piece has a bottom circumferential edge, a first recess, and a second recess within the first recess. The vacuum shroud body may also include a plurality of air holes defined by the bottom piece, the plurality of air inlets being (i) disposed about the bottom circumferential edge and (ii) disposed within a channel defined by the bottom piece. In some embodiments, the top piece of the shroud body includes an overhang extending from a top circumferential edge toward a middle of the shroud body. The overhang may define a slot in communication with the channel defined by the bottom piece such that the plurality of air holes are protected from dust and debris by the overhang of the top piece. In some embodiments, air enters the vacuum shroud through the slot defined by the overhang, flows through the plurality of air holes, and exits the plurality of air holes from the bottom surface of the bottom piece. There may be no air holes or opening disposed on external surfaces of the shroud body.

Also disclosed are adjustable collars for attaching a grinder to a vacuum shroud body. An adjustable collar may include a first half and a second half connectable to the first half. The first half may include a base and a projection extending from the base, with the projection defining a first plurality of holes to receive a plurality of fasteners. The second half may be connectable to the projection of the first half and may define a second plurality of holes to align with the first plurality of holes of the first half and receive the plurality of fasteners. Additionally, the adjustable collar may include a grinder attachment void for receiving the grinder and connecting the grinder to the vacuum shroud. The grinder attachment void may be defined between the first half and the second half when the first half and the second half are in a fastened configuration. A size of the grinder attachment void may be adjustable through a position of the plurality of fasteners in the fastened configuration.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Figure 1:
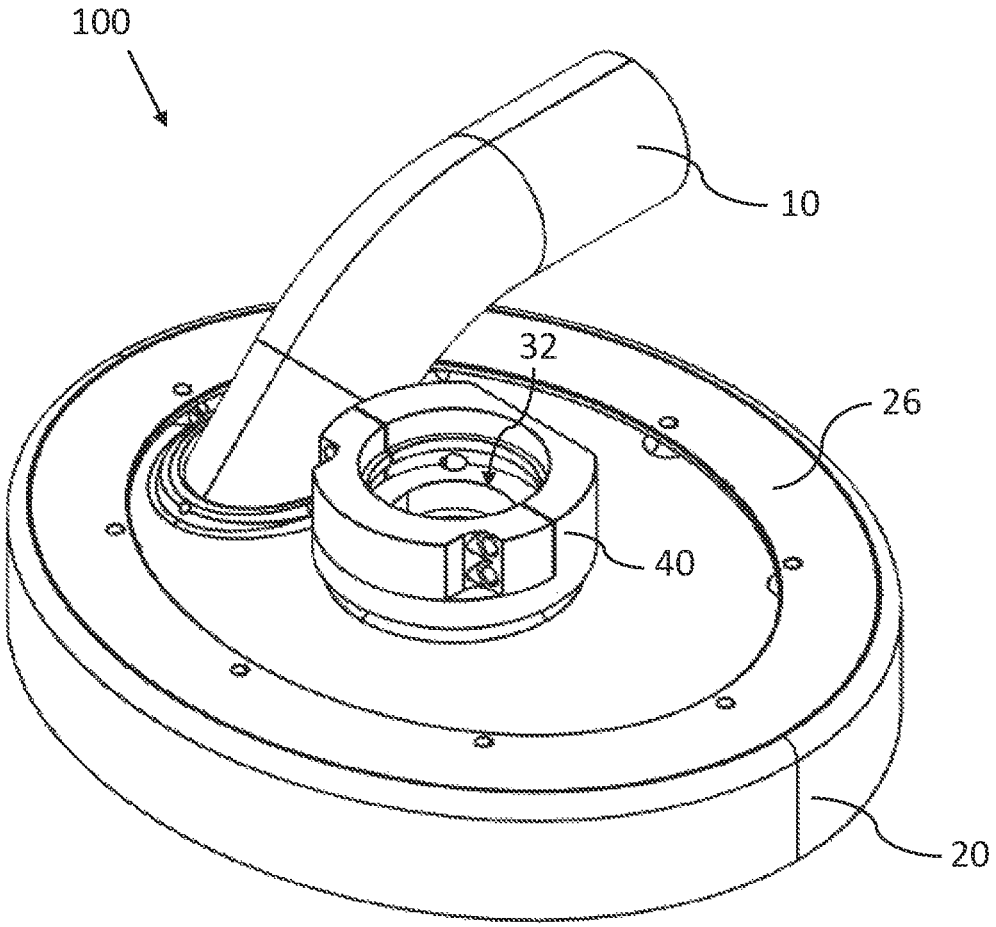
FIG. 1 illustrates a perspective view of one embodiment of a vacuum shroud system according to the present disclosure.

Tile removal and other grinding processes create large amounts of dust and debris and are often accomplished using power rotary tools which, in turn, tend to create more dust and debris. Vacuum shrouds accomplish the task of removing the dust from the air. However, most vacuum shrouds require air intake holes in order to function properly and this in turn creates an opportunity for debris to fly out of these air intake holes. Typically, the air intake holes are located on outer and exterior portions of the vacuum shrouds, meaning the air intake holes are fully exposed to dust and debris produced during the tile removal and other grinding processes. This can lead to the air intake holes becoming quickly clogged with the produced dust and debris, which can negatively impact the efficiency and effectiveness of the vacuum shrouds.

Conventional vacuum shrouds typically utilize plastic for all or most of the construction of the shroud. For example, the shroud body may be entirely made of plastic. While this use of plastic may ultimately make the shroud lighter and easier to pick up, it also means the shroud bodies are easier to break, such as if a heavier object is dropped onto or bumped into the shroud body. The plastic of the shroud body may even break if the shroud is bumped into a wall with just enough force. As these shrouds are typically employed in spaces having walls (e.g., tile grinding in a bathroom), the probability that the shroud body will run into a wall is high. Once a portion of the shroud body breaks, the entire device needs to be replaced, which can increase costs in money and time to complete a project.

Additionally, conventional shrouds typically use screws (e.g., set screws) to directly attach a grinder to the shroud body. Unfortunately, these screws may not evenly or levelly attach the grinder to the shroud body. In use, the grinder hinges and rocks around the screws and the shroud body, which leads to increased wear on the grinder, meaning the grinder must be replaced more frequently. Grinders are typically expensive, so replacing them more frequently also increases the cost of any given project. Not only do the screws unevenly attach the grinder to the shroud body, the screws also tighten within their holes as the device is used. This means the screws are not easy to take out in order to replace or refit the grinder to the shroud body.

Various embodiments of the present disclosure address these and other problems. Disclosed are systems, devices, and/or methods of use thereof regarding shrouds having grinder and vacuum hose attachments. In various aspects, a vacuum shroud system can include a shroud body having a top surface and a bottom surface. The shroud body may include a plurality of air holes defined by the shroud body and extending from the top surface to the bottom surface, a vacuum attachment void defined by the shroud body and extending from the top surface to the bottom surface, and a grinder attachment void defined by the shroud body and extending from the top surface to the bottom surface. The vacuum shroud system may also include an adjustable collar comprising a first half and a second half, the adjustable collar disposed over the grinder attachment void of the shroud body. Additionally, the system may include a cover securable to the top surface of the shroud body, where the cover overhangs a top edge of the top surface to protect the plurality of air holes. The system may further include a vacuum hose securable within the vacuum attachment void, with a wall of the vacuum attachment void determining an outlet angle for the vacuum hose, and a grinder securable within the grinder attachment void through the adjustable collar.

In other aspect, a vacuum shroud of the present disclosure may include a shroud body and a vacuum attachment void for receiving a vacuum hose. The vacuum attachment void may be defined by a vacuum wall and the shroud body, with the vacuum wall and the vacuum attachment void extending from a top surface to a bottom surface of the shroud body. In some embodiments, the vacuum wall extends from the top surface to the bottom surface of the shroud body at an angle of less than about 90°, such that a flow of air through the vacuum attachment void is not required to make a 90° turn as the air flows from the bottom surface of the shroud body through the vacuum attachment void and into the vacuum hose. In some configurations, the angle may be about 45°, about 50°, about 55°, about 60°, about 65°, about 70°, about 75°, about 80°, or about 85°, or any other angle within a range below 90°.

In some embodiments, a vacuum shroud may include a shroud body having a top piece and a bottom piece, where a bottom surface of the bottom piece has a bottom circumferential edge, a first recess, and a second recess within the first recess. The vacuum shroud body may also include a plurality of air holes defined by the bottom piece, the plurality of air inlets being (i) disposed about the bottom circumferential edge and (ii) disposed within a channel defined by the bottom piece. In some embodiments, the top piece of the shroud body includes an overhang extending from a top circumferential edge toward a middle of the shroud body. The overhang may define a slot in substantial alignment with the channel defined by the bottom piece such that the plurality of air holes are protected from dust and debris by the overhang of the top piece. In some embodiments, air enters the vacuum shroud through the slot defined by the overhang, flows through the plurality of air holes, and exits the plurality of air holes from the bottom surface of the bottom piece. There may be no air holes or opening disposed on external surfaces of the shroud body.

Also disclosed are adjustable collars for attaching a grinder to a vacuum shroud body. An adjustable collar may include a first half and a second half connectable to the first half. The first half may include a base and a projection extending from the base, with the projection defining a first plurality of holes to receive a plurality of fasteners. The second half may be connectable to the projection of the first half and may define a second plurality of holes to align with the first plurality of holes and receive the plurality of fasteners. Additionally, the adjustable collar may include a grinder attachment void for receiving the grinder and connecting the grinder to the vacuum shroud; the grinder attachment void may be defined between the first half and the second half when the projection and the second half are in a fastened configuration. A size of the grinder attachment void may be adjustable through a position of the plurality of fasteners in the fastened configuration.

Figure 2:
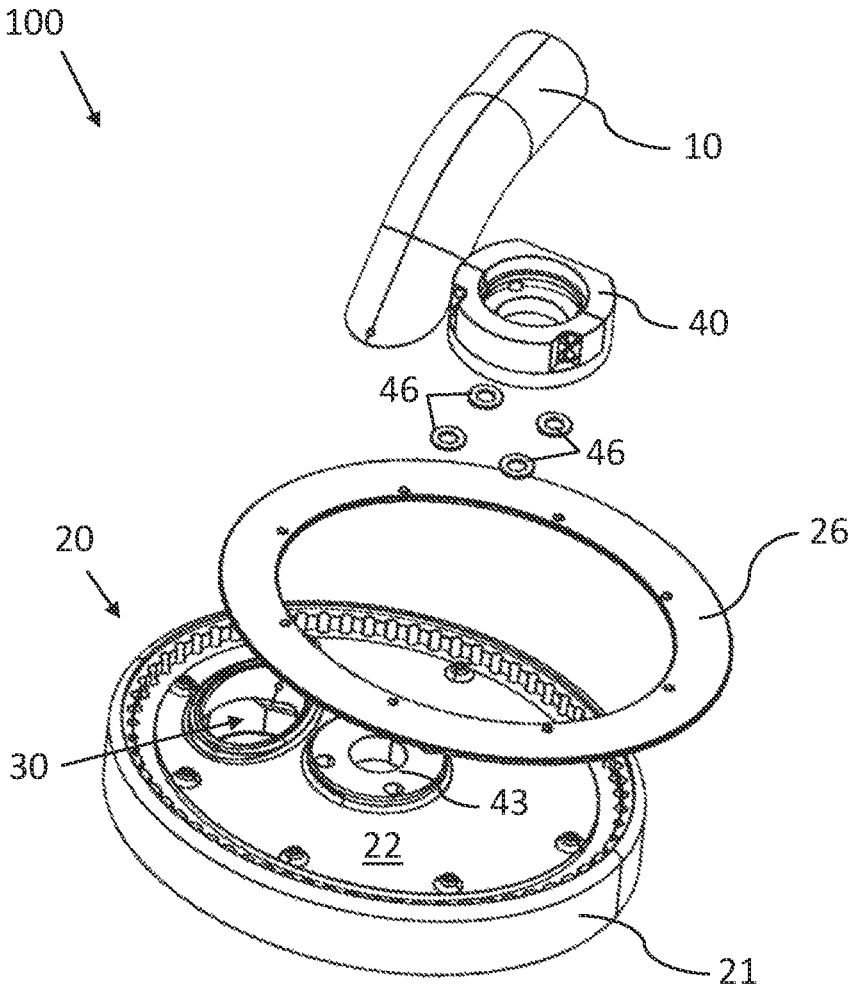
FIG. 2 illustrates an exploded view of the vacuum shroud system of FIG. 1.

FIG. 1 illustrates a perspective view and FIG. 2 illustrate an exploded view of one embodiment of a vacuum shroud system 100 according to the present disclosure. As illustrated, the system 100 includes a vacuum hose or vacuum outlet 10, a vacuum shroud or shroud 20, an adjustable collar 40, and a cover 26. As described more fully below, the vacuum hose 10 is in connection with a vacuum attachment void 30, and the vacuum hose 10 is formed with an angle of less than about 90°, such that dust that travels from the vacuum attachment void 30 to the vacuum hose 10 does not have to pass by a 90° angle. Placing the vacuum hose 10 at such an angle ensures that a flow of air through the system 100 and through the hose 10 does not have to take a sharp turn (e.g., a 90° turn) to enter a vacuum bag attached to the hose 10. This decreases a rate of degradation for the system 100 while also improving air flow and/or suction through the system 100 by about 25% (e.g., about 15%, 20%, 30%, or 35%).

The adjustable collar 40 is for attaching a grinder to the vacuum shroud system 100. Any suitable grinder may be attached. The adjustable collar 40 may define a grinder attachment void 32 for receiving the grinder. As described more fully below, a size (e.g., diameter, etc.) of the grinder attachment void 32 is adjustable to accommodate a variety of different sized grinders. The size of grinder chosen may be appropriate for a particular grinding process.

Figure 5A:
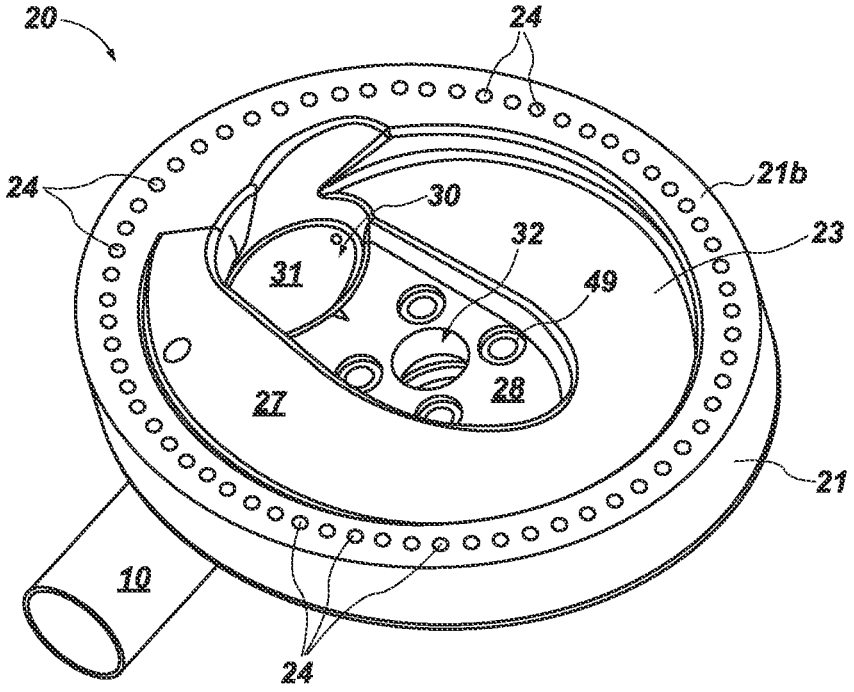
FIGS. 5A-5B illustrate perspective views of the bottom surface of the vacuum shroud body from the vacuum shroud system of FIG. 1.
Figure 5B:
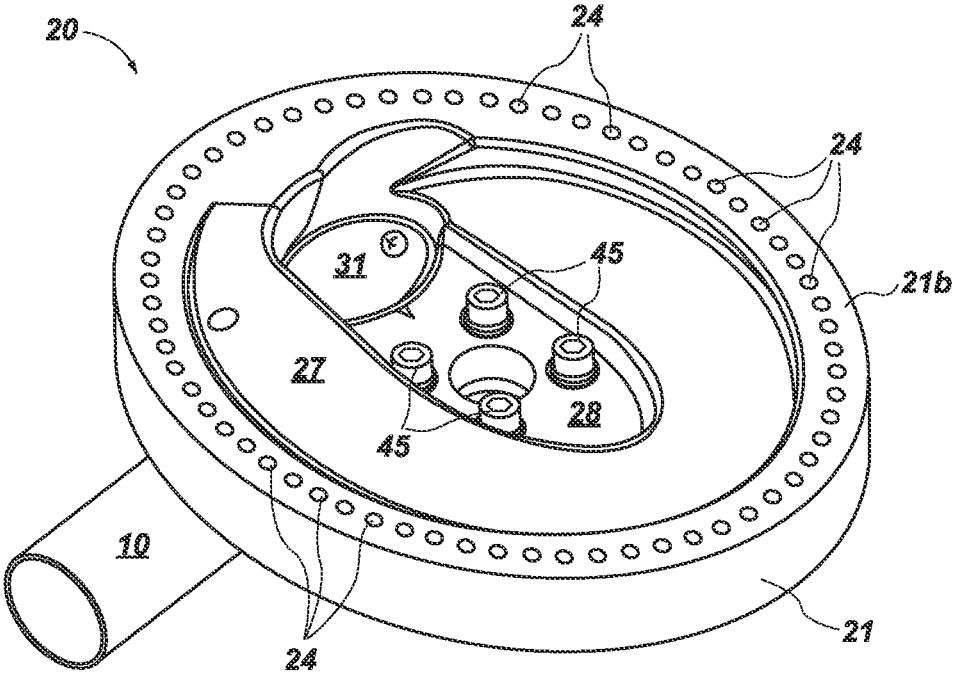

As seen in FIG. 2, the shroud 20 includes a shroud body 21 having a top surface 22 and a bottom surface 23 opposite the top surface 22 (see FIGS. 5A-5B). In some embodiments, the shroud body 21 is a single piece defining various cavities, voids, holes, etc. The vacuum attachment void 30 is defined by the shroud body 21 and extends from the top surface 22 to the bottom surface 23. The adjustable collar 40 attaches to or otherwise interfaces with shroud body 21 and the top surface 22 through a mount 43 and one or more fastening mechanisms, which may include one or more washers 46. The cover 26 attaches to or otherwise interfaces with the shroud body 21. In some embodiments, as discussed more fully below, the cover 26 together with the top surface 22 of the shroud body 21 defines a slot, channel, or overhang near the top edge of the shroud body 21; that is, the cover 26 overhangs from a top edge of the shroud body 21 onto a portion of the top surface 22 such that the cover 26 and top surface 22 define a slot or channel.

The slot, channel, or overhang is configured to protect a plurality of air holes (e.g., a plurality of air inlets) from dust and/or debris created during a grinding process, such as a tile removal process. Covering the plurality of air holes protects them from getting clogged or otherwise filled of dust and debris which, ultimately, prolongs the usable life of the vacuum shroud system 100.

Figure 3:
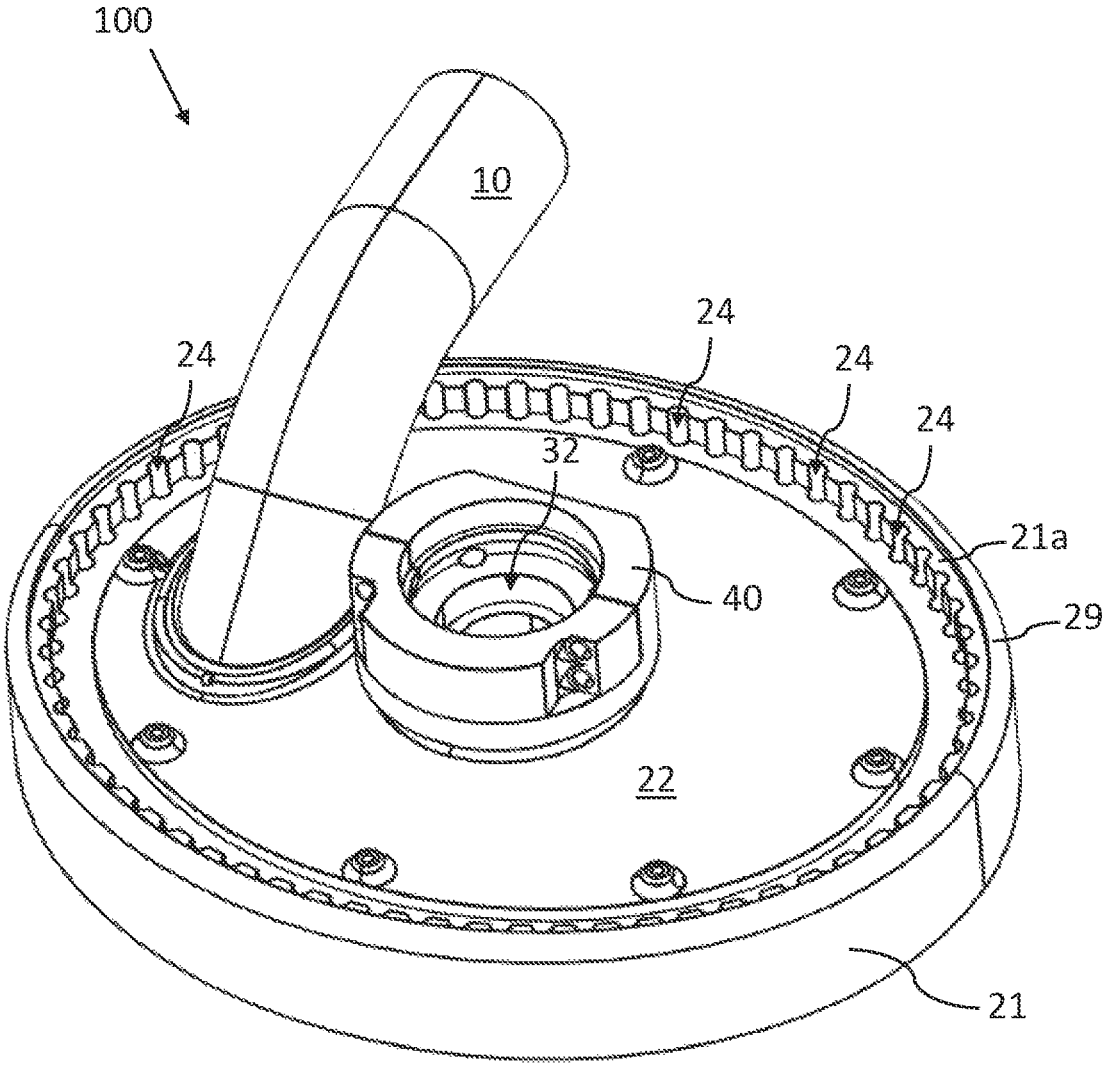
FIG. 3 illustrates a perspective view of the vacuum shroud system of FIG. 1 with a cover removed.
Figure 4A:
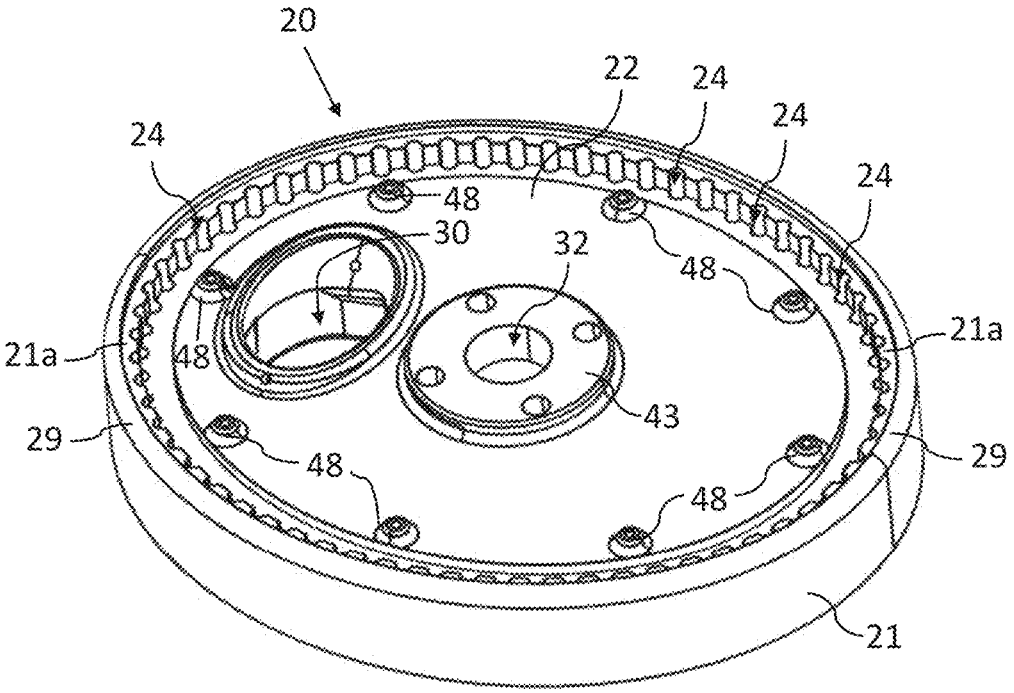
FIGS. 4A-4B illustrate perspective views of the top surface of a vacuum shroud body from the vacuum shroud system of FIG. 1.
Figure 4B:
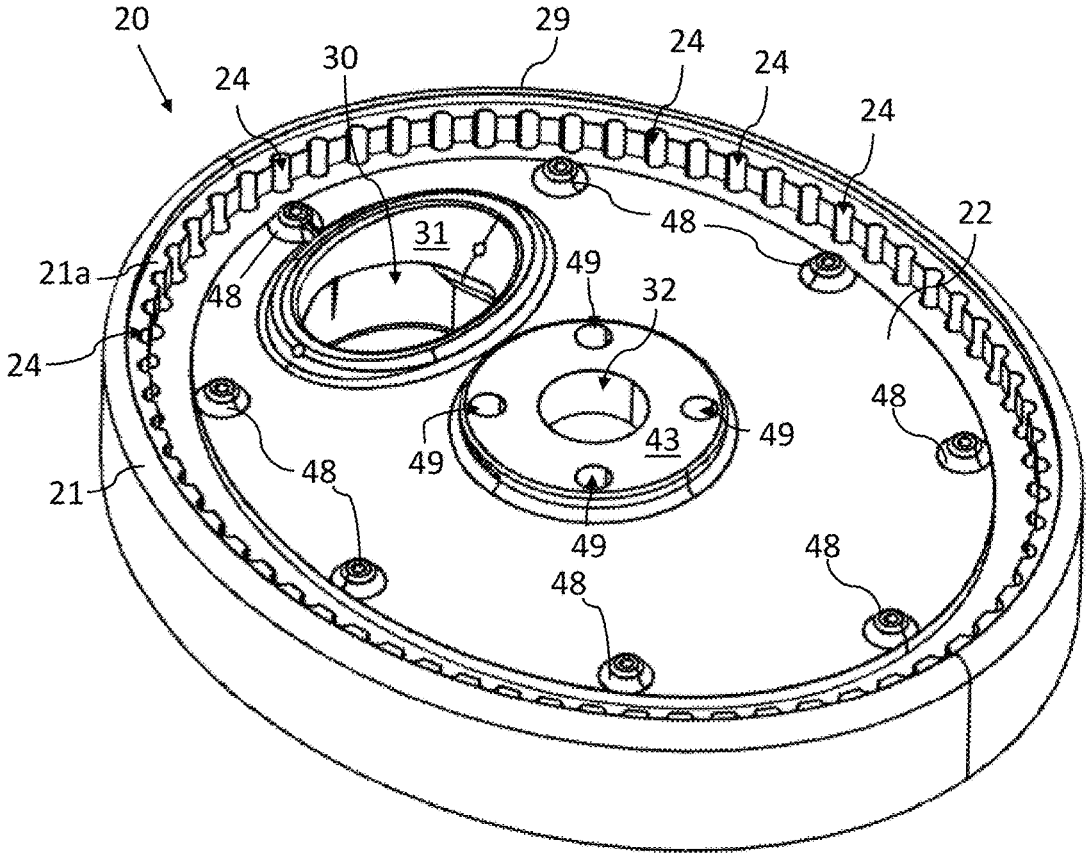

FIGS. 3-4B illustrate perspective views of the shroud body 21 and the top surface 22 of the vacuum shroud system 100 of FIG. 1. In FIG. 3, the cover 26 has been removed, and in FIGS. 4A-4B the hose 10 and adjustable collar 40 have additionally been removed for clarity. As before, the system 100 includes the shroud body 21, the vacuum hose 10, and the adjustable collar 40, shown mounted to the top surface 22 of the shroud body 21 via mount 43. The shroud body 21 additionally includes a top circumferential edge or top edge 29 and a shelf 21*a*. The top surface 22 may be recessed relative to the top circumferential edge 29, and the shelf 21*a* may provide a stepped transition between the top edge 29 and the top surface 22. The shroud body 21 additionally defines a plurality of air holes or air inlets 24 disposed about an outer circumference of the shroud body 21.

As seen best in FIG. 4B, the plurality of air holes 24 extend from the shelf 21*a*, through the shroud body 21, and to the bottom surface 23 (see FIGS. 5A-5B). In this way, the plurality of air holes 24 are not externally exposed from the shroud body 21. Rather, the plurality of air holes 24 are inwardly positioned and/or defined within the shroud body 21 due, in part, to the recessed nature of the top surface 22 relative to the top circumferential edge 29. The inwardly positioned plurality of air holes 24 are protected from dust and debris created during a grinding process (e.g., a tile grinding process) that is not captured by the suction created through the vacuum hose 10.

The top surface 22 of the shroud body 21 defines the vacuum attachment void 30; the top surface 22 and the mount 43 define the grinder attachment void 32. Referring briefly to FIG. 4B, the vacuum attachment void 30 extends from the top surface 22 to the bottom surface 23 and includes a wall 31. In some embodiments, the wall 31 and the vacuum attachment void 30 extend through the shroud body 21 at an angle that is less than about 90°, such as 25°, 30°, 40°, 45°, 50°, 60°, 70°, 75°, 80°, or an angle within a range defined by any two of the foregoing values.

The angle of the wall 31 is less than about 900 to position the vacuum hose 10 at an angle of less than about 900 as the hose 10 exits the vacuum attachment void 30. Positioning the vacuum hose 10 at an angle of less than about 900 improves the overall suctioning capacity and efficiency of the vacuum system 100 as a flow of suctioned air (and dust and debris within the suctioned air) is not required to make a sharp 900 turn to exit the system 100 and into a vacuum bag. In some embodiments, positioning the vacuum hose 10 at an angle of less than about 90° improves the overall suctioning capacity and efficiency of the vacuum system 100 by about 25%, such as 15%, 20%, 30%, 35%, or a percentage within a range defined by any two of the foregoing values. In some embodiments, positioning the vacuum hose 10 at an angle of less than about 90°, or having a vacuum hose with an angle of less than about 90°, improves the longevity of the system and the vacuum hose. For example, the angle of less than about 900 can reduce forceful impacts by dust and debris against the inside of the vacuum hose.

The top surface of the shroud body 21 also defines the grinder attachment void 32, which extends from the top surface 22 to the bottom surface 23. The mount 43 may additionally define the grinder attachment void 32. In some embodiments, the mount 43 is a separate component adhered or otherwise attached to the top surface 22 of the shroud body 21. In other embodiments, the mount 43 may be an upward extension or projection of the top surface 22 of the shroud body 21. The mount 43 may define or include one or more holes 49 for receiving screws or other fasteners in order to attach the adjustable collar 40 to the mount 43.

Disposed about the circumference of the shroud body 21 are a plurality of fasteners 48. In some embodiments, the plurality of fasteners 48 are for attaching the cover 26 to the shelf 21*a* of the shroud body 21. The plurality of fasteners 48 may include screws, set screws, snaps, clips, detents, or other appropriate fastening mechanism.

FIGS. 5A-5B illustrate perspective views of the bottom surface 23 of the vacuum shroud body 21. The bottom surface 23 is opposite the top surface 22 of the shroud body 21. As illustrated, the bottom surface 23 includes the plurality of air holes 24, a first recess 27, and a second recess 28. The vacuum attachment void 30 and the grinder attachment void 32 may both extend from the top surface 22 through to the second recess 28 of the bottom surface 23. A depth of the first recess 27 and/or the second recess 28 may correspond to a particular grinder process (e.g., a tile grinding process). In some embodiments, the first recess 27 may act as a collection chamber where dust and particles can collect before being suctioned through the vacuum attachment void 30. This may contribute to a substantially "dust free" result through use of the vacuum shroud 20.

As before, the vacuum attachment void 30 includes a wall 31 that extends at an angle from the top surface 22 through to the bottom surface 23. The angle of the wall 31 is configured to position the vacuum hose 10 (see FIG. 1) at an angle of the less than 90° as the vacuum hose 10 exits the vacuum attachment void 30. Also disposed within the second recess 28 are the plurality of holes 49, defined in the top surface 22, by the mount 43. The plurality of holes 49 are for receiving screws or other fasteners 45 to attach and secure the adjustable collar 40 to the mount 43 and the shroud body 21. In some embodiments, the screws or other fasteners 45 include set screws or any other suitable screws.

The plurality of air holes 24 are disposed about a bottom circumferential edge 21*b* of the bottom surface 23. Similar to the position of the plurality of air holes 24 at the top surface 22, the plurality of air holes 24 are disposed inwardly of the bottom circumferential edge 21*b* of the bottom surface 23.

Figure 6A:
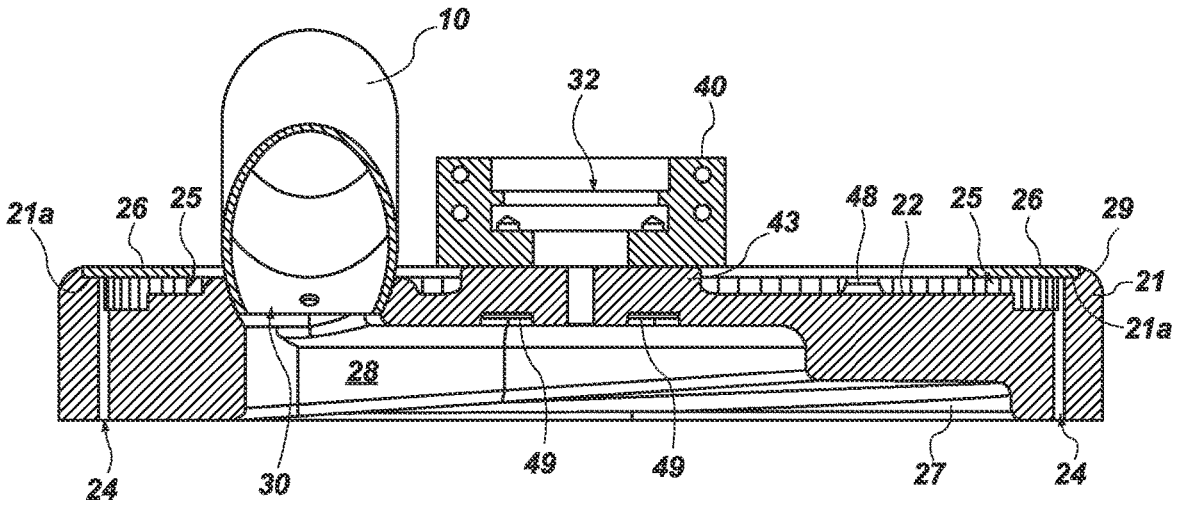
FIGS. 6A-6B illustrate front cross-sectional views of the vacuum shroud body from the vacuum shroud system of FIG. 1.
Figure 6B:
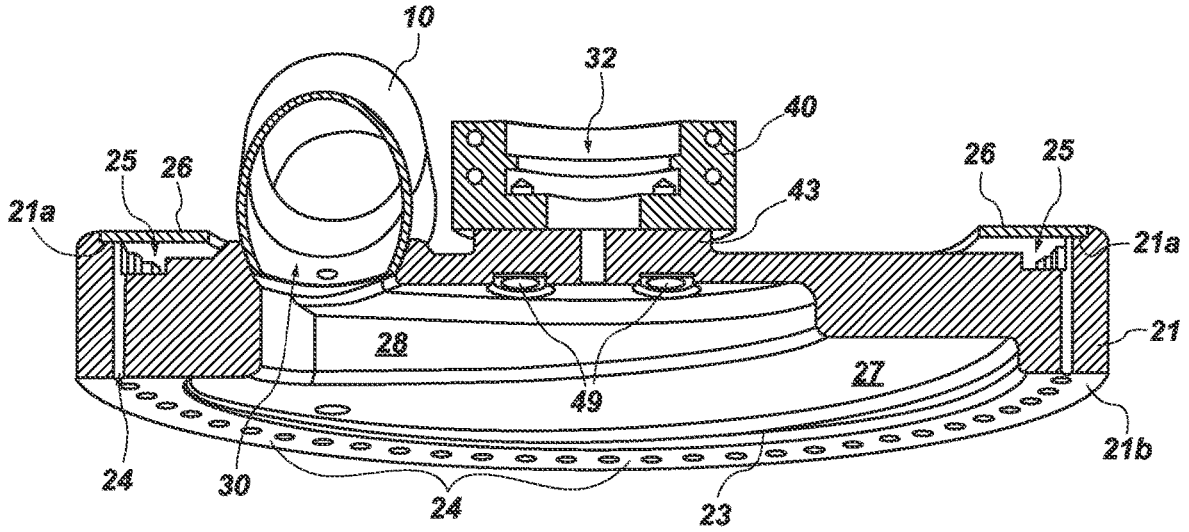

FIGS. 6A-6B illustrate front cross-sectional views of the vacuum shroud system 100 of FIG. 1. As illustrated and as before, the system 100 includes the vacuum hose 10 disposed within the vacuum attachment void 30, the adjustable collar 40 attached to the top surface 22 via the mount 43, the shroud body 21, and the cover 26. In some embodiments, the shroud body 21 is substantially a single, unitary piece or element defining various voids, holes, cavities, etc. In some embodiments, the shroud body 21 may be constructed from metal, metal alloys, plastic, acrylics, composite materials, etc.

In some embodiments, the shelf 21*a* is for receiving or otherwise interfacing with the cover 26. Specifically, as shown, an outer edge of the cover 26 may be received, rest on, or otherwise abut the shelf 21*a*. An inner edge of the cover 26 may be secured to one or more fasteners 48. In this way, the cover 26 extends or overhangs from the shelf 21*a* at approximately the top circumferential edge 29 of the shroud body 21 toward a center of the shroud body 21 (i.e., in a direction toward the vacuum hose 10 and the adjustable collar 40). As illustrated, the cover 26 overhangs and covers the plurality of air holes 24. Specifically, the cover 26 and the top surface 22 define a slot, channel, or overhanging space 25 in which the plurality of air holes 24 are positioned.

The positioning of the plurality of air holes 24 within the slot 25 and under the cover 26 protects the plurality of air holes 24 from dust and debris created during a grinding process. Such protection prevents the plurality of air holes 24 from being prematurely clogged as well as maintains an efficiency of a suction force created by a vacuum attached via the vacuum hose 10. For example, a flow of air from outside of the shroud body 21, through the slot 25, through the plurality of air holes 24, and out of the plurality of air holes 24 at the bottom surface 23 is not impeded due to the presence of the cover 26 and the protection it provides to the plurality of air holes 24. Because the flow of air is not impeded through the shroud body 21 and/or the plurality of air holes 24, the overall suction force and capacity of the vacuum shroud system 100 is improved (e.g., the overall suction force can be maintained for longer periods of time).

Figure 7:
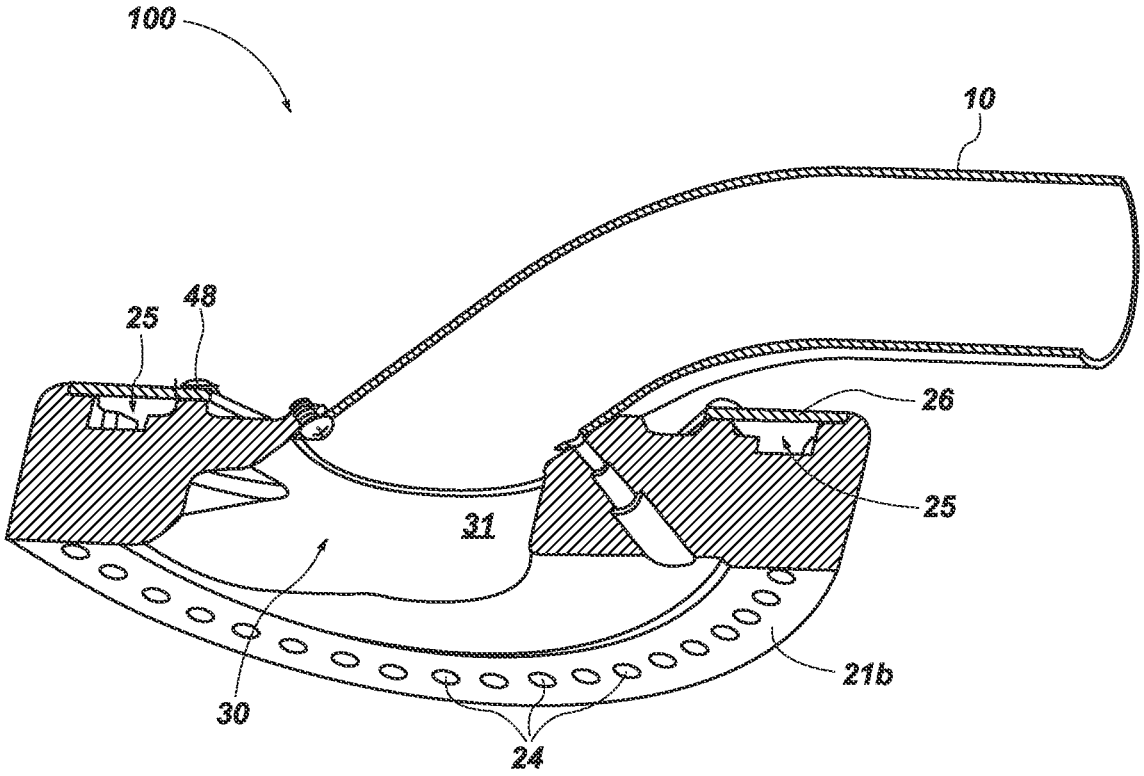
FIG. 7 illustrates a side cross-sectional view of the vacuum shroud body from the vacuum shroud system of FIG. 1.

FIG. 7 illustrates a perspective side cross-sectional view of the vacuum portion of the vacuum shroud system 100. The vacuum hose 10 is illustrated disposed within or in connection with the vacuum attachment void 30 and extending at an angle out of the vacuum attachment void 30. Specifically, the vacuum hose 10 extends and exits the vacuum attachment void 30 at an angle of less than about 90°, thereby improving the suction capacity as discussed elsewhere. The vacuum hose 10 is disposed within the void 30 and held in place by one or more screws or fasteners. In other configurations, the vacuum hose 10 may be integrally formed with the shroud, such as integrally formed with a shroud body 21.

Figure 8:
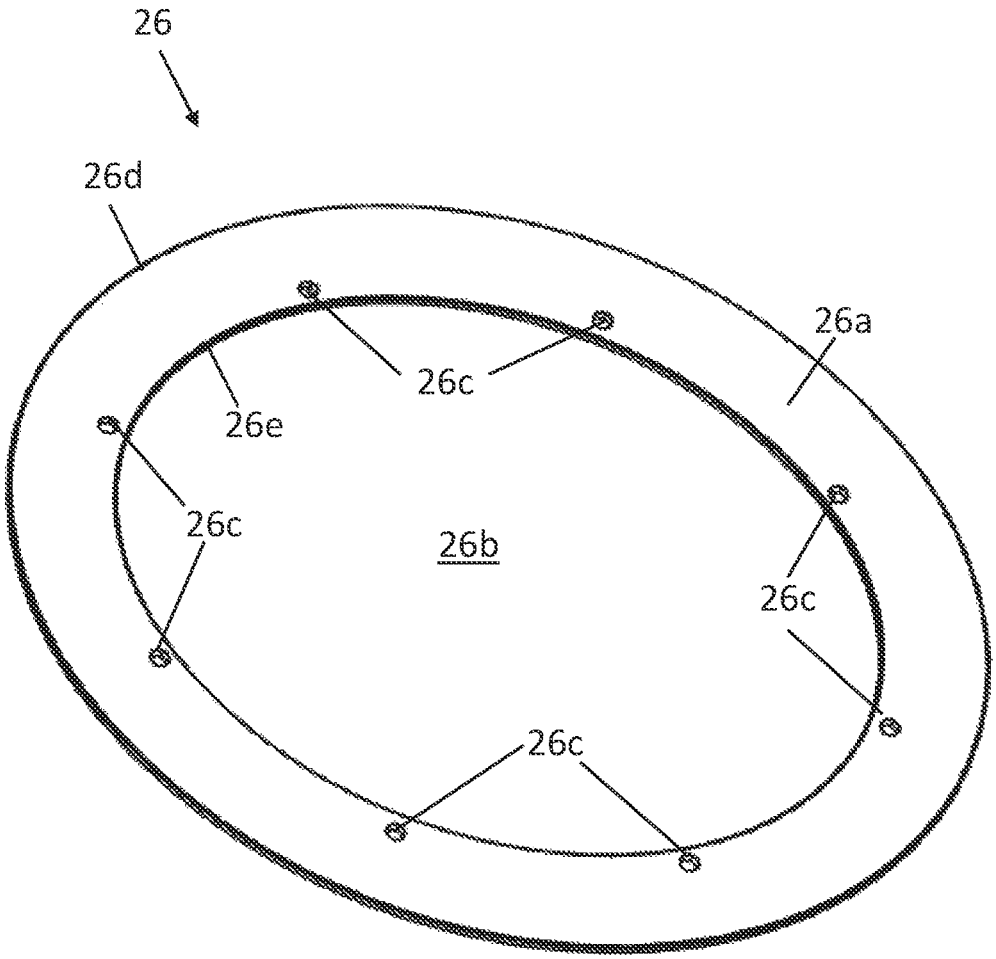
FIG. 8 illustrates a perspective view of one embodiment of the cover for the vacuum shroud system of FIG. 1.

FIG. 8 illustrates a perspective view of one embodiment of the cover 26 for the vacuum shroud system 100. The cover 26 includes a body 26*a* having an outer edge 26*d* and an inner edge 26*e*. The body 26*a* and/or the inner edge 26*e* defines an opening 26*b* of the cover 26. A size or diameter of the opening 26*b* may correspond to a size of (i) the vacuum hose 10, (ii) the adjustable collar 40, and/or (iii) a grinder secured to the system 100 via the adjustable collar 40. A size of the body 26*a* may correspond to a size of the shroud body 21 of the system 100. Disposed near the inner edge 26*e* are a plurality of holes 26*c* for receiving fasteners to attach the cover 26 to the shroud body 21. In some embodiments, the plurality of holes 26*c* receive one or more fasteners 48 to attach the cover 26 to the top surface 22 of the shroud body 21 (see FIGS. 6A-7).

Figure 9A:
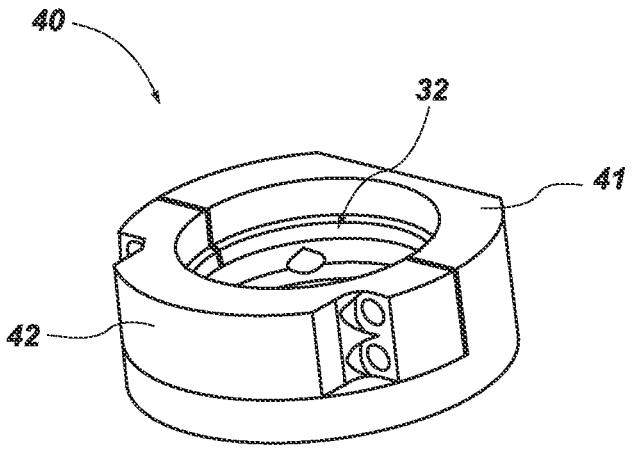
FIG. 9A illustrates a perspective view of one embodiment of an adjustable collar for attaching a grinder to a vacuum shroud system, such as the vacuum shroud system of FIG. 1.
Figure 9B:
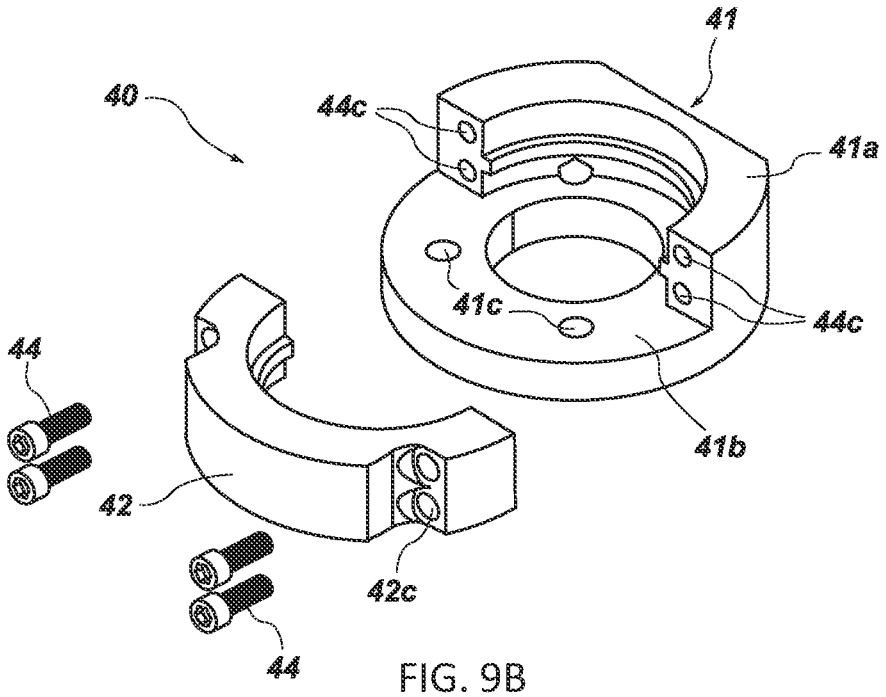
FIG. 9B illustrates a perspective, exploded view of the collar of FIG. 9A.

FIGS. 9A-9B illustrate perspective views of one embodiment of an adjustable collar 40 for attaching a grinder to the vacuum shroud system 100 of FIG. 1. In some embodiments, the adjustable collar 40 includes a first half 41 and a second half 42 that is joinable, connectable, and/or securable to the first half 41. Specifically, the first half 41 includes a base 41*b* and a projection 41*a* extending upwardly from the base 41*b*; the second half 42 is connectable or securable to the projection 41*a*. In some embodiments, the second half 42 rests or abuts the base 41*b* when connected or secured to the projection 41*a*. The base 41*b* may define one or more holes 41*c* for receiving one or more fasteners to attach the adjustable collar 40 to the shroud body 21.

When the first half 41 and the second half 42 are in a fastened configuration, they define the grinder attachment void 32 or a portion of the void 32 (the top surface 22 and the mount 43 define another portion of the grinder attachment void 32). A size of the grinder attachment void 32 is adjustable based on a position or configuration of the first half 41 and the second half 42. For example, as illustrated in FIG. 9B, the projection 41*a* of the first half 41 defines one or more holes 44*c* for receiving one or more fasteners 44. Likewise, the second half 42 defines one or more holes 42*c* for receiving the one or more fasteners 44. A position of the one or more fasteners 44 in and through the one or more holes 42*c*, 44*c* may determine or correspond to the size of the grinder attachment void 32.

The adjustable collar 40 may be a universal collar. Specifically, the adjustable collar 40 may be sized and shaped to accommodate any size, shape, and/or brand of grinder. For example, the size of the grinder attachment void 32 may be adjusted to accommodate a specific size and/or brand of grinder. The size of the void 32 may be adjusted based on (i) a size of the first half 41 and/or the second half 42 and/or (ii) a position of the fasteners within the one or more holes 41*c*. Similarly, a shape of the void 32 may be adjusted based on (i) a shape of the first half 41 and/or the second half 42 and/or (ii) a position of the fasteners within the one or more holes 41*c*. In this way, the adjustable collar 40 may universally attach a grinder to the shroud 20.

Further, the universal nature of the adjustable collar 40 may result in a modular vacuum shroud system 100. The adjustable collar 40 may be removed from a first shroud body 21 and attached to a second, different shroud body 21. The differences between the first and second shroud bodies 21 may be in size, shape, type of grinder, type of attachment, etc. The adjustable collar 40 may allow for a dynamic and modular vacuum shroud system 100.

Figure 10A:
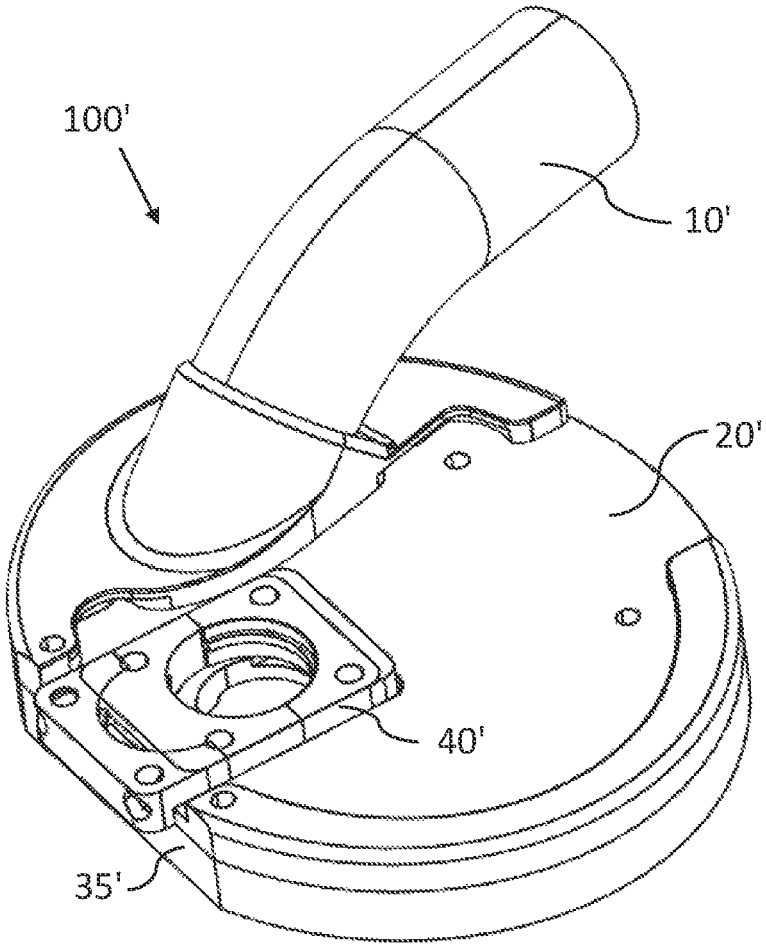
FIGS. 10A-10C illustrate front and back perspective views of another embodiment of a vacuum shroud system.
Figure 10B:
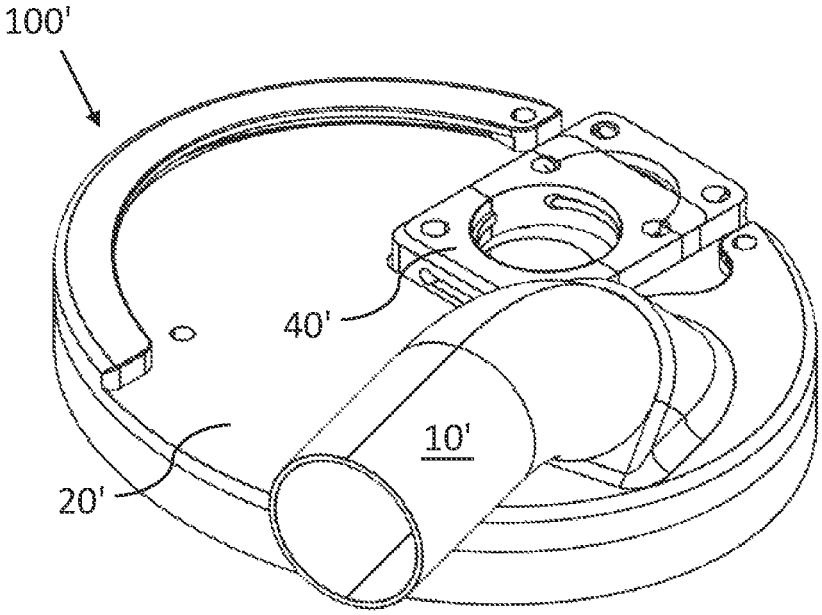
Figure 10C:
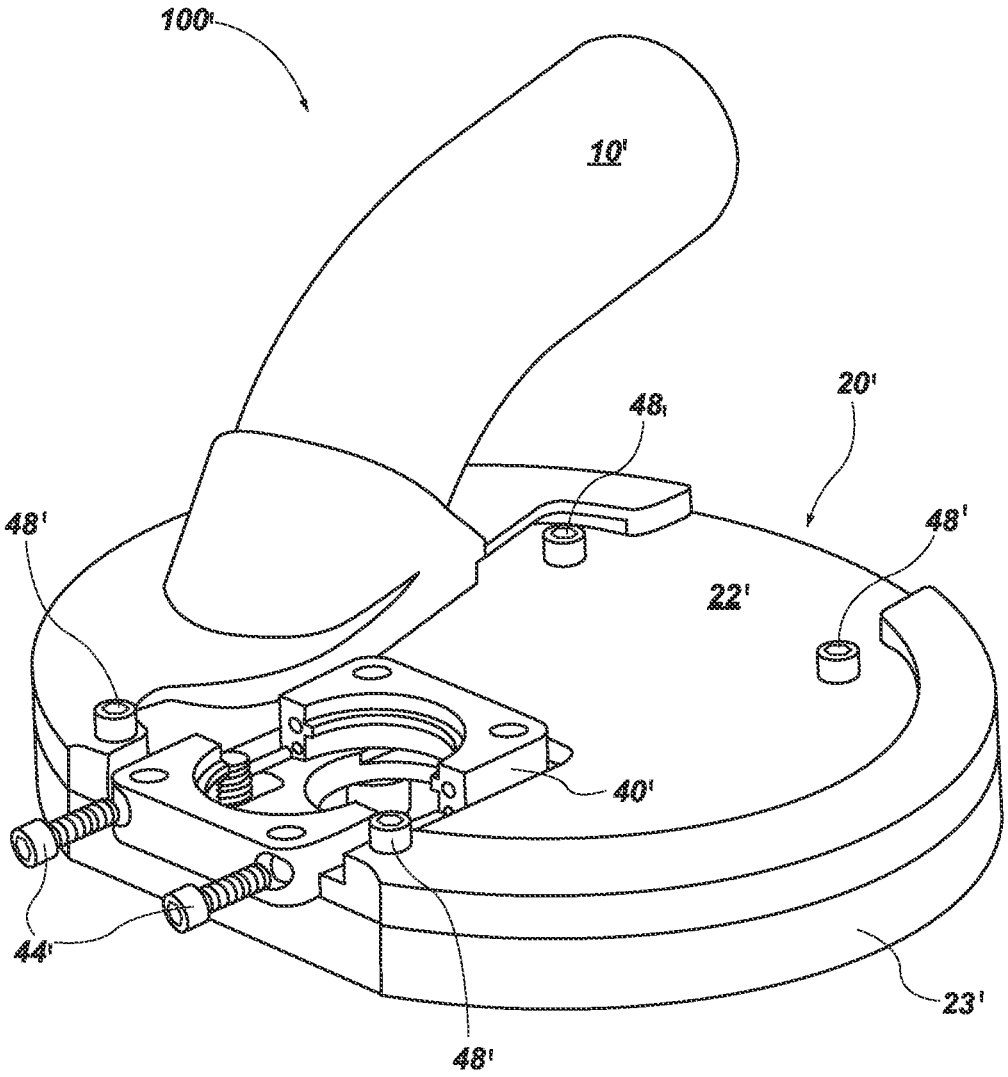
Figure 11:
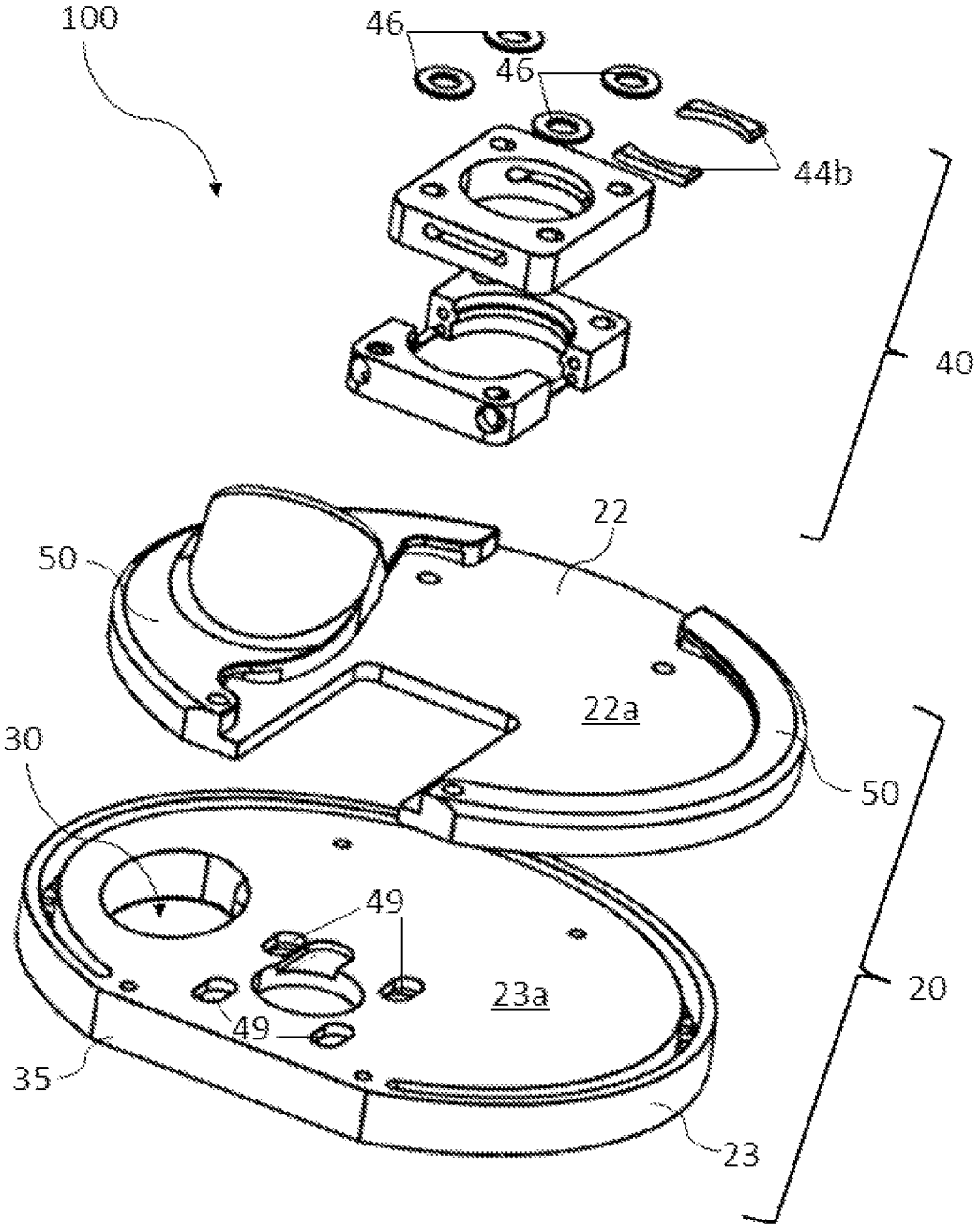
FIG. 11 illustrates an exploded view of the vacuum shroud system of FIGS. 10A-10C.

Turning now to FIGS. 10A-11, FIGS. 10A-10C illustrate front and back perspective views and FIG. 11 illustrates an exploded view of another embodiment of a vacuum shroud system 100' according to the present disclosure. The discussion of the vacuum shroud system 100' of FIGS. 1-9B is relevant to the discussion of the vacuum shroud system 100' of FIGS. 10A-17C, so like elements will be labelled with like reference numerals.

As before, the vacuum shroud system 100' includes a vacuum hose 10', a shroud 20', and an adjustable collar 40'. As illustrated, the shroud 20' includes a flat front edge 35' that allows the shroud 20' and/or the vacuum shroud system 100' to be brought or positioned in close proximity to a wall or other vertically planar surface. This allows the system 100' to engage in a grinding process close to or even up against walls or vertically planar surfaces. In contrast, the system 100 of FIG. 1 has a rounded shroud 20 and may not be able to come into as close proximity to a wall or vertically planar surface. It will be appreciated that the shroud can have any suitable shape desired depending on the desired functionality; for example, the shroud may have a flat side to engage closely with a wall, a 90-degree corner to engage a corner, a round shape, an ovular shape, etc.

As illustrated in FIGS. 10C-11, the shroud 20' may include a top piece 22' and a bottom piece 23' secured to the top piece 22' via, for example, fasteners 48'. In this embodiment, the shroud 20' is not a single, unitary element, though the top piece and the bottom piece 23' may be constructed from the same material. In other embodiments, the shroud 20' may be formed as a unitary element.

The top piece 22' and/or the top surface 22*a'* may define a cut-out or void 34' (most clearly visible in FIGS. 11-12C) for receiving the adjustable collar 40'. As with the adjustable collar 40, the adjustable collar 40' may include two halves secured together via fasteners, such as screws 44' and dowel tabs 44*b'*, which allow for adjusting a size or diameter of an opening defined by the adjustable collar 40' (e.g., adjusting the grinder attachment void 32'). The adjustable collar 40' may be secured to the bottom piece 23' via one or more fasteners and one or more washers 46'.

The top piece 22' has a top surface 22*a'* and an extension 50' that extends upward from the top surface 22*a'*. The extension 50' may have a similar function to the cover 26 for protecting the plurality of air holes 24' (see FIGS. 13A-13B). In other configurations, a cover may be provided. As illustrated, the extension 50' is disposed about a circumferential edge of the top surface 22*a'*. In some embodiments, the extension 50' together with the top surface 22*a'* defines a slot or channel for protecting the plurality of air holes 24'.

The bottom piece 23' (discussed more fully with respect to FIGS. 13A-14B) has a top surface 23*a'*, which may define (i) a vacuum attachment void 30', (ii) holes 49' for receiving fasteners to secure the adjustable collar 40' to the shroud 20', and (iii) a slot 25*b'* in which the plurality of air holes 24' may be disposed.

Figure 12A:
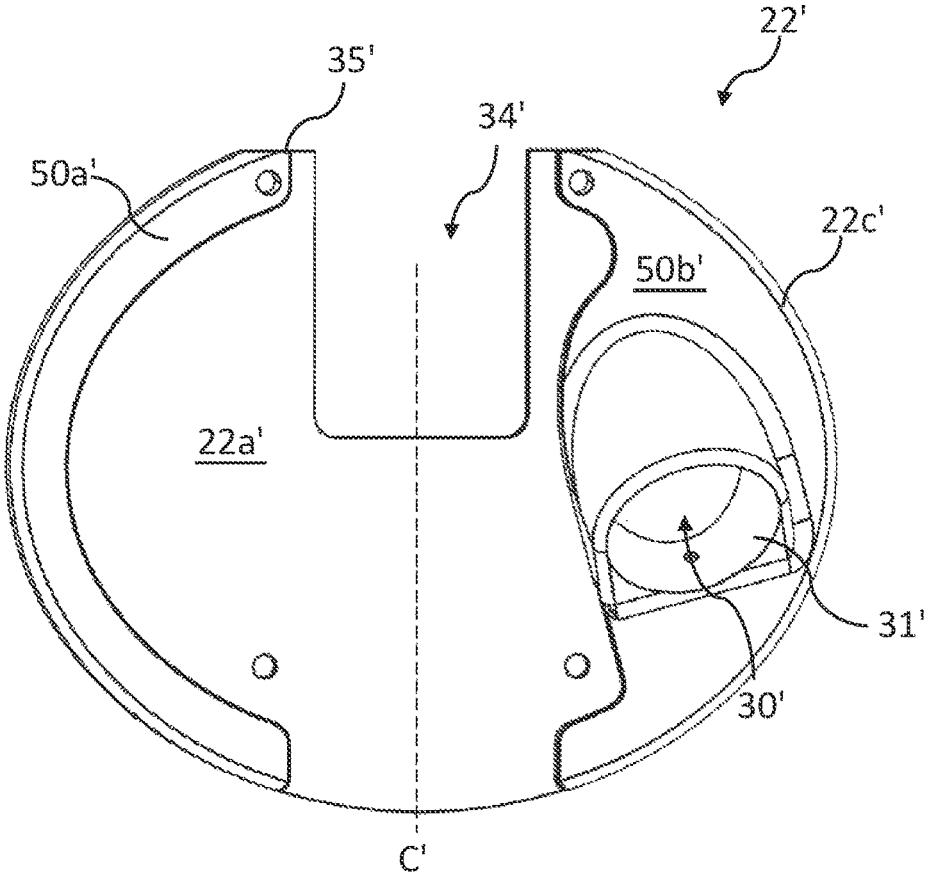
FIG. 12A illustrates a top plan view.
Figure 12B:
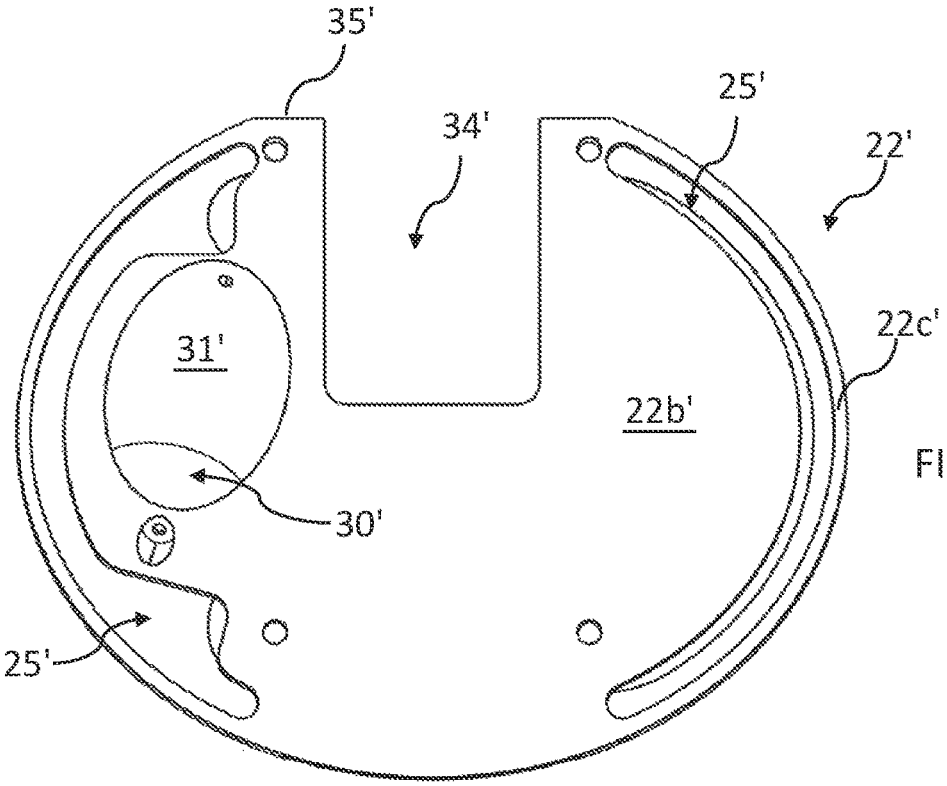
FIG. 12B illustrates a bottom plan view.
Figure 12C:
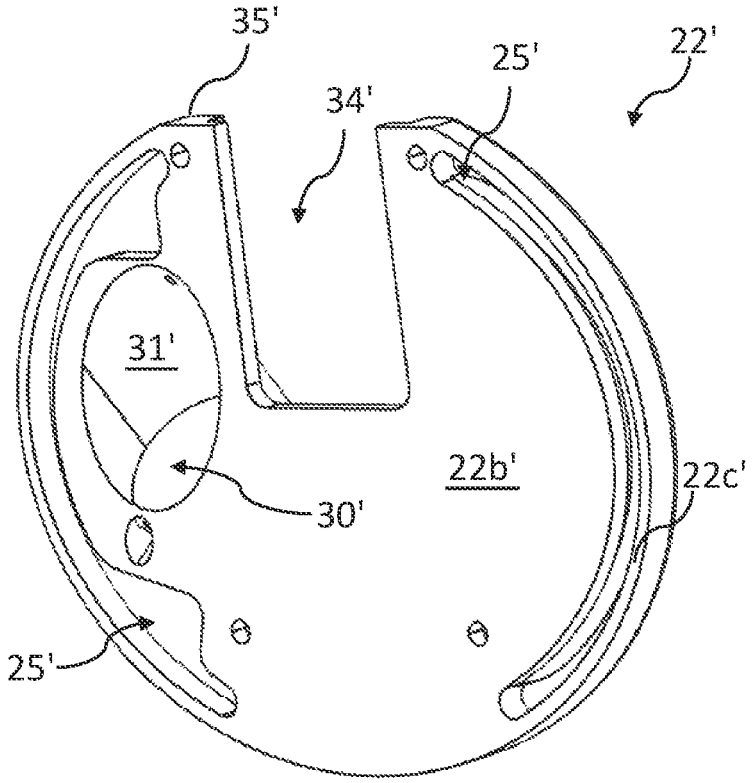
FIG. 12C illustrates a bottom perspective view of a top piece of a vacuum shroud of the vacuum shroud system of FIGS. 10A-10C.

FIG. 12A illustrates a top plan view, FIG. 12B illustrates a bottom plan view, and FIG. 12C illustrates a bottom perspective view of the top piece 22' of the vacuum shroud 20'. As shown, the top piece 22' includes the flat front edge 35' and has a top surface 22*a'* defining the cut-out 34' for receiving the adjustable collar 40'. The extension 50' is disposed about a circumferential edge 22*c'* of the top surface 22*a'*. As illustrated, the extension 50' does not extend fully around the circumference of the top surface 22*a'* but is (somewhat symmetrically) disposed about a central axis C' of the top piece 22', such that the extension 50' has a first half 50*a'* and a second half 50*b'*. In other configurations the extension 50' may extend fully or partially around the circumference of the top surface 22*a'* and me be formed as a single piece, as two or more pieces, etc.

The top piece 22', the top surface 22*a'*, and/or a second half 50*b'* of the extension 50' define the vacuum attachment void 30'. In some embodiments, a wall 31' of the vacuum attachment void 30' merges with the second half 50*b'* to create a tunnel to receive the vacuum hose 10'. The opening or space within the tunnel is continuous and in fluid communication with the vacuum attachment void 30'; the tunnel-like nature of the wall 31' provides a more secure attachment of the vacuum hose 10' within the void 30'. In some configurations, the vacuum hose 10' is integral to the top piece 22'.

Similar to the system 100 of FIGS. 1-7, in some embodiments, the wall 31' and/or the vacuum attachment void 30' extend through the shroud 20' at an angle that is less than about 90°, such as 25°, 30°, 40°, 45°, 50°, 60°, 70°, 75°, 80°, or an angle within a range defined by any two of the foregoing values. The angle of the wall 31' is less than about 900 to position the vacuum hose 10' at an angle of less than about 900 as the hose 10' exits the vacuum attachment void 30'. Positioning the vacuum hose 10' at an angle of less than about 90° improves the overall suctioning capacity and efficiency of the vacuum system 100' as a flow of suctioned air (and dust and debris within the suctioned air) is not required to make a sharp 90° turn to exit the system 100' and into a vacuum bag. In some embodiments, positioning the vacuum hose 10' at an angle of less than about 900 improves the overall suctioning capacity and efficiency of the vacuum system 100' by about 25%, such as 15%, 20%, 30%, 35%, or a percentage within a range defined by any two of the foregoing values. In some embodiments, positioning the vacuum hose 10 at an angle of less than about 90°, or having a vacuum hose with an angle of less than about 90°, improves the longevity of the system and the vacuum hose. For example, the angle of less than about 900 can reduce forceful impacts by dust and debris against the inside of the vacuum hose.

The top piece 22' also has a bottom surface 22*b'* opposite the top surface 22*a'*. The bottom surface 22*b'* may define a slot or channel 25' which is covered, on the top surface 22*a'*, by the extension 50'. The slot or channel 25' may substantially align with a slot 25*b'* of the bottom piece 23' to protect the plurality of air holes 24' from dust and debris created during a grinding process. The slot 25' may disposed about a circumferential edge 22*c'* of the top piece 22'. In some embodiments, the slot 25' is continuous and substantially uniform as it extends ab out the circumferential edge 22*c'*; in some embodiments, portions of the slot 25' include enlarge areas (e.g., enlarged ends) or narrower portions to accommodate other features of the shroud system 100', such as the vacuum attachment void 30'.

Figure 13A:
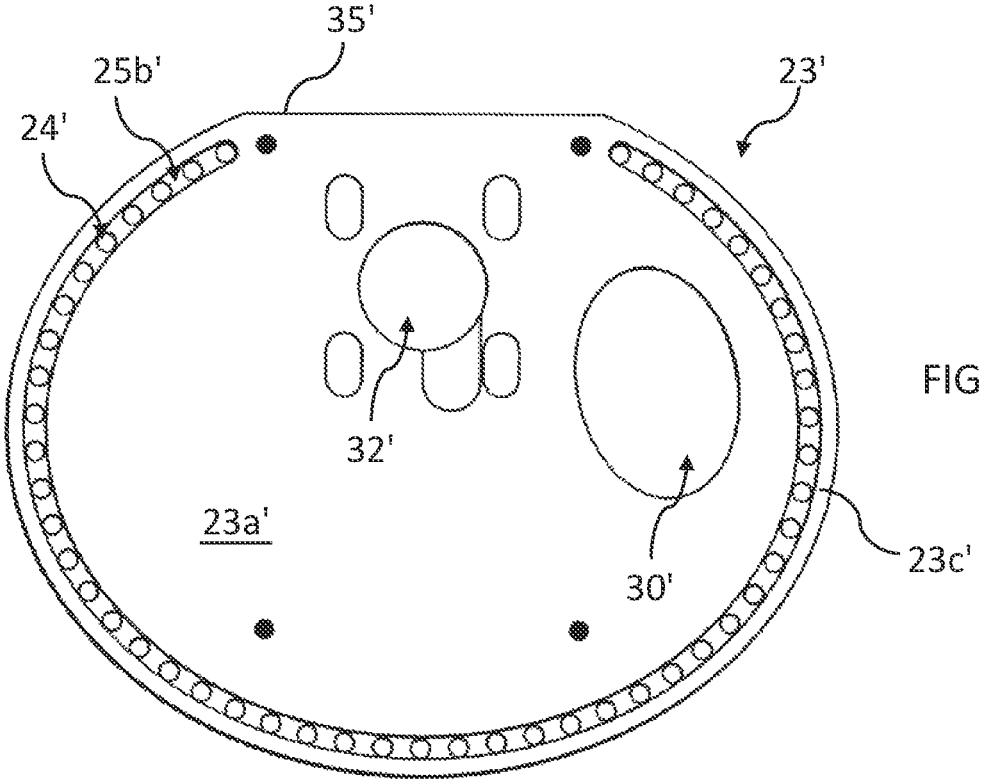
FIGS. 13A-13B illustrate top plan and perspective views, respectively, of a bottom piece of the vacuum shroud of the vacuum shroud system of FIGS. 10A-10C.
Figure 13B:
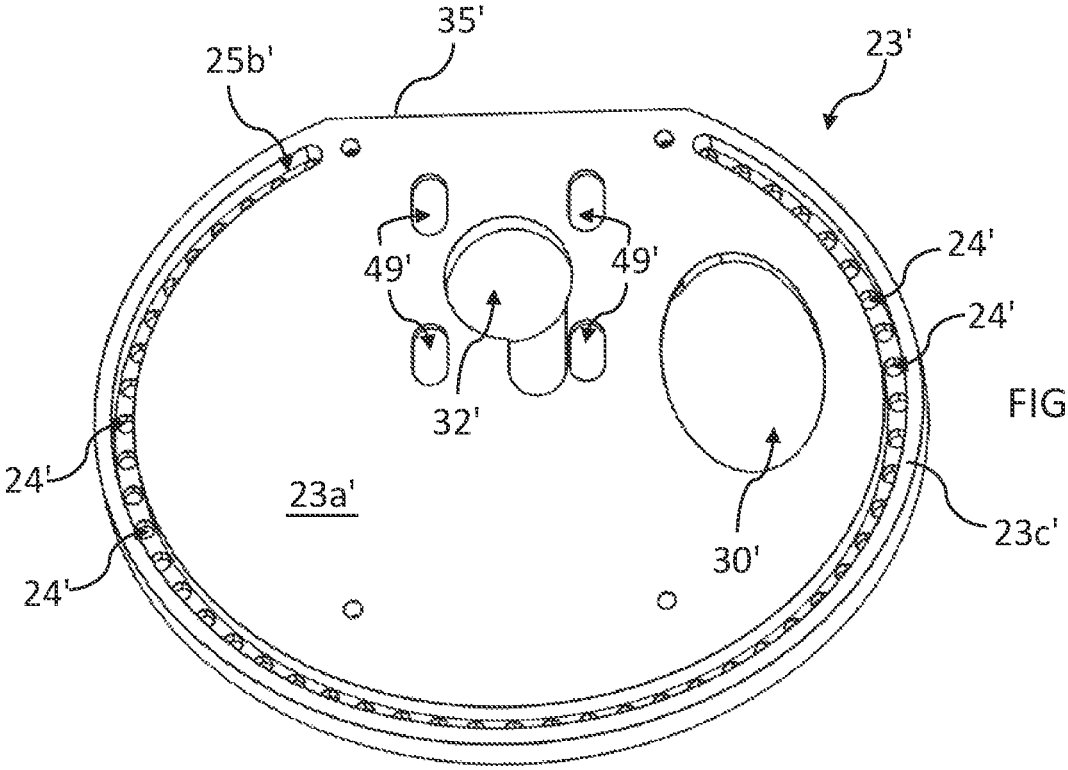

FIGS. 13A-13B illustrate top plan and perspective views, respectively, of the bottom piece 23' of the vacuum shroud 20' of the vacuum shroud system 100' of FIGS. 10A-10C. As illustrated, the bottom piece 23' includes the flat front edge 35' and has a top surface 23*a'*. The top surface 23*a'* may abut or contact the bottom surface 22*b'* of the top piece 22' when the bottom piece 23' is secured to the top piece 22'. The top surface 23*a'* may define (i) the slot 25*b'* within which the plurality of air holes 24' are disposed, (ii) the grinder attachment void 32', (iii) the vacuum attachment void 30', and (iv) one or more holes 49' for receiving one or more fasteners to secure the adjustable collar 40' to the shroud 20'. The top surface 23*a*', in conjunction with the bottom surface 23*b*', may define the plurality of air holes 24'. As before, positioning the plurality of air holes 24' within the slot 25*b*' protects the plurality of air holes 24' from dust and debris (i.e., prevents the plurality of air holes 24' from becoming prematurely or undesirably clogged with dust and debris). Protecting the plurality of air holes 24' maintains an overall suction force of the system 100'.

In some embodiments, the one or more holes 49' have an elongated or oblong shape to allow for adjustability of the adjustable collar 40'. Specifically, the elongated shape of the one or more holes 49' allows a position fasteners or screws within the one or more holes 49' to be adjusted, thereby adjusting a size or diameter of an opening within the adjustable collar 40'. Such adjustability allows the adjustable collar 40' to accommodate a wide variety of, for example, grinder sizes such that a wide variety of grinders may be secured to the shroud 20' and used in a grinding process (e.g., a tile grinding process). In some embodiments, the screws or other fasteners include set screws.

The elongated shape of the one or more holes 49' can also allow a forward/backward position of fasteners or screws within the one or more holes 49' to be adjusted, thereby moving the adjustable collar 40' forward or backward relative to the shroud 20'. Such adjustability allows the adjustable collar 40' to accommodate a wide variety of grinders for use in conjunction with the shroud 20'.

Figure 14A:
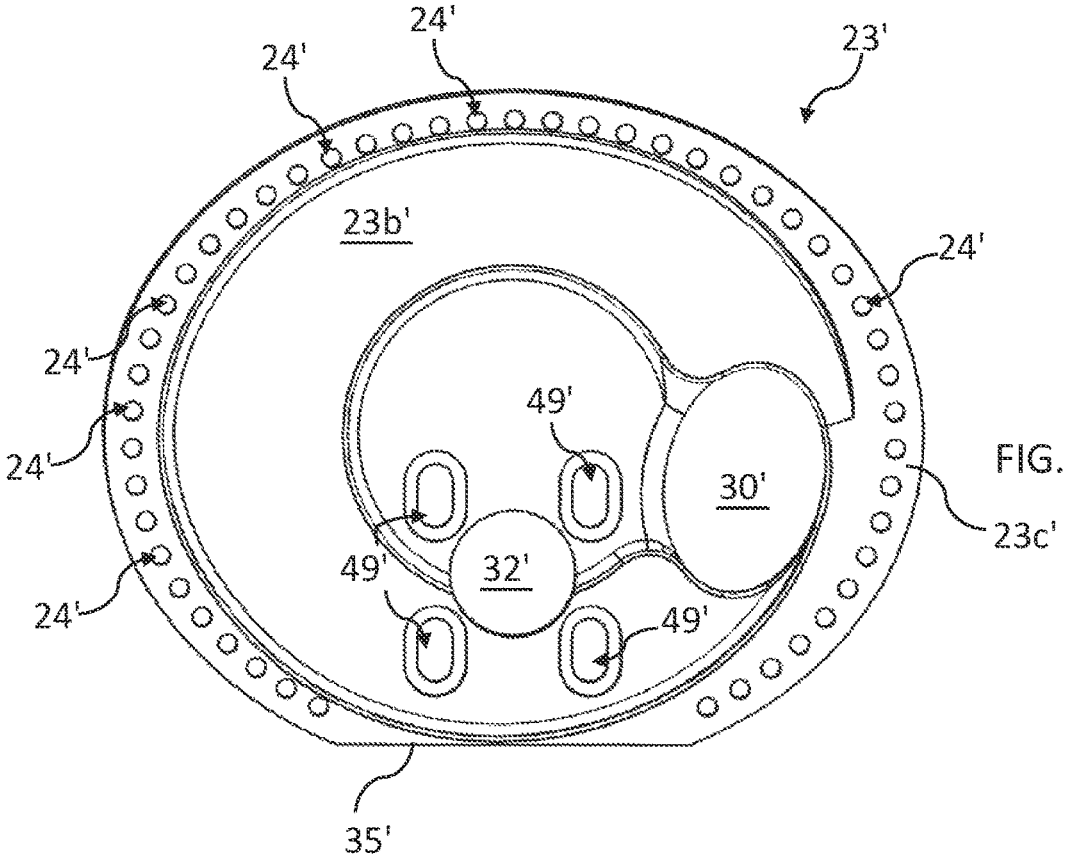
FIGS. 14A-14B illustrate bottom plan and perspective views, respectively, of the bottom piece of the vacuum shroud of FIGS. 13A-13B.
Figure 14B:
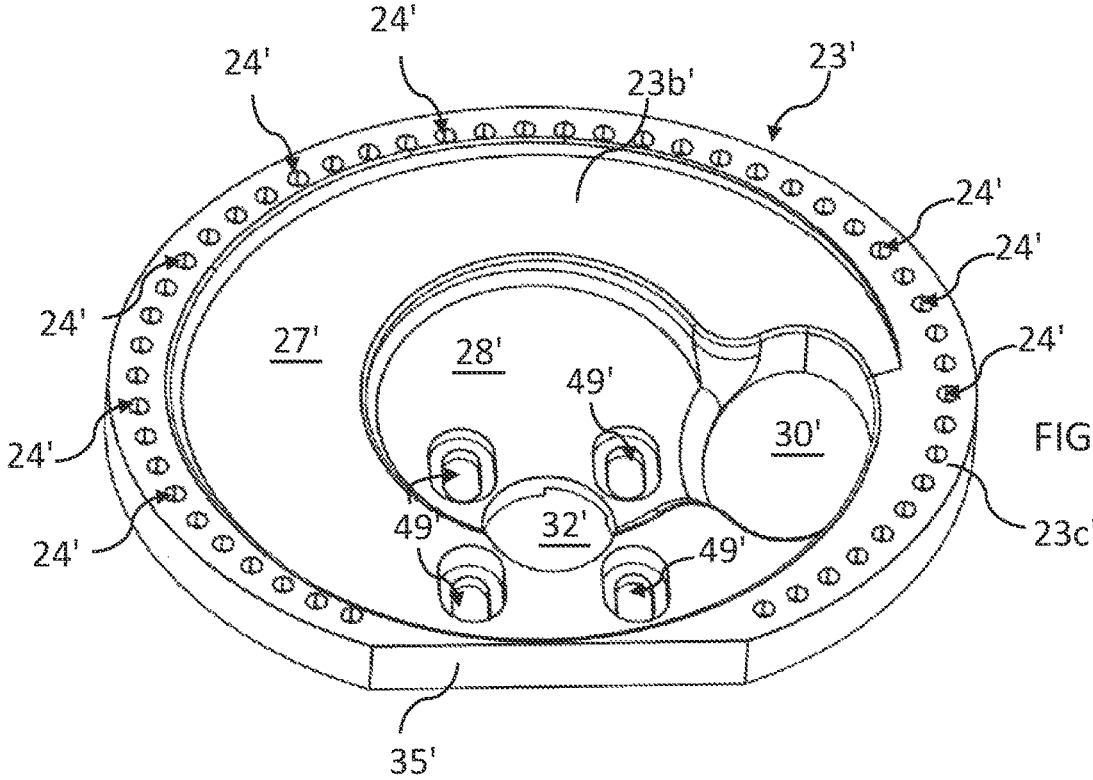

FIGS. 14A-14B illustrate bottom plan and perspective views, respectively, of the bottom piece 23' of the vacuum shroud 20'. Specifically illustrated is the bottom surface 23*b*' of the bottom piece 23'. Similar to the bottom surface 23*b*, the bottom surface 23*b*' includes the plurality of air holes 24', a first recess 27', and a second recess 28'. The bottom surface 23*b*' may additionally include or define the one or more holes 49'. The vacuum attachment void 30', the grinder attachment void 32', and at least one of the one or more holes 49' may extend from the top surface 23*a*' through to the second recess 28' of the bottom surface 23*b*'. Specifically, the vacuum attachment void 30' extends through the top piece 22' (e.g., from the top surface 22*a*' to the bottom surface 22*b*') and through the bottom piece 23' (e.g., from the top surface 23*a*' to the bottom surface 23*b*').

In some embodiments, a portion of the grinder attachment void 32' is positioned within the first recess 27' and a portion is positioned within the second recess 28'. In such embodiments, the grinder attachment void 32' may have a sloped or ramped configuration to account for the differing depths between the first and second recesses 27', 28'. In some embodiments, the depth between the first and second recesses 27', 28' is small enough that the grinder attachment void 32' does not have a sloped or ramped configuration. A depth of the first recess 27 and/or the second recess 28 may correspond to a particular grinder process (e.g., a tile grinding process) or a particular type or size of grinder attached to the shroud 20'.

Figure 15A:
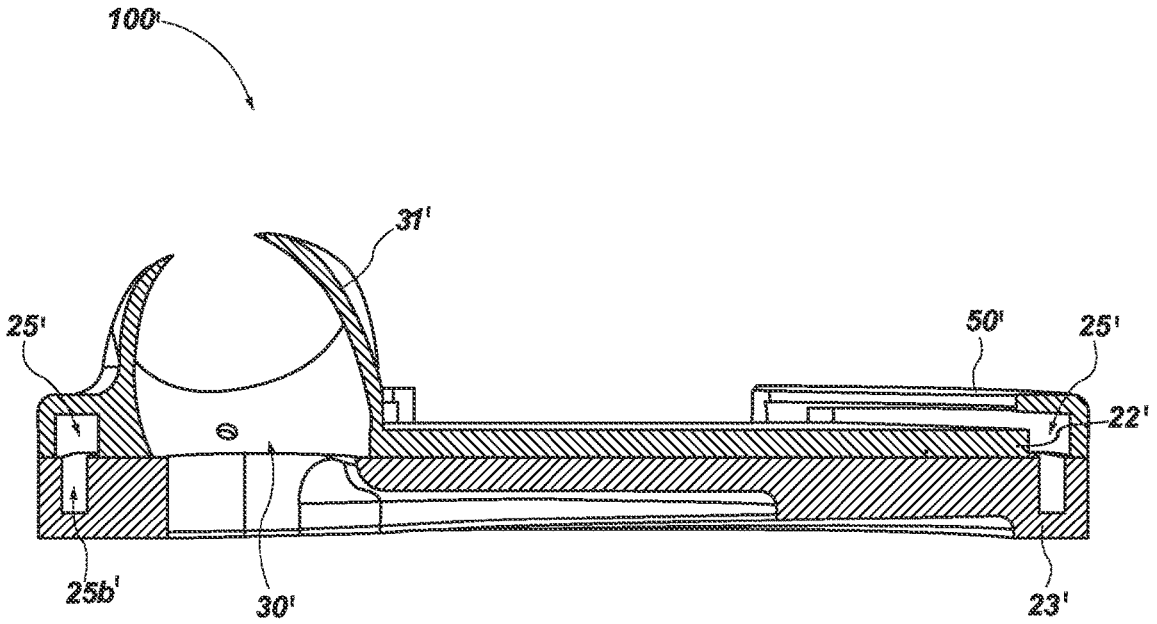
FIGS. 15A-15B illustrate front cross-sectional views of the vacuum shroud body from the vacuum shroud system of FIGS. 10A-10C.

Similar to the bottom surface 23 of the shroud 20 of FIGS. 5A-5B, the plurality of air holes 24' may be disposed about a circumferential edge 23*c*' of the bottom surface 23*b*' and the bottom piece 23'. The positioning of the plurality of air holes 24' about the circumferential edge 23*c*' also places the plurality of air holes 24' at a bottom of the slot 25*b*' (FIG. 15A). As the top piece 22' and bottom piece 23' abut each other (e.g., the top surface 23*a*' of the bottom piece 23' abuts the bottom surface 22*b*' of the top piece 22') when fastened together, the slot 25' defined by the top piece 22' may be substantially continuous with the slot 25*b*' defined by the bottom piece 23' or may be in fluid communication with the slot 25*b*'. In this way, the plurality of air holes 24' are adequately covered and protected by the extension 50' of the top piece 22', as the extension 50' (i) is positioned over the slot 25' and (ii) contributes to the definition of the slot 25'.

For example, a flow of air from outside of the shroud 20', through the slot 25', through the plurality of air holes 24', and out of the plurality of air holes 24' at the bottom surface 23*b*' is not impeded due to the presence of the extension 50' and the protection it provides to the plurality of air holes 24'. Because the flow of air is not impeded through the shroud 20' and/or the plurality of air holes 24', the overall suction force and capacity of the vacuum shroud system 100' is improved (e.g., the overall suction force can be maintained for longer periods of time).

Figure 15B:
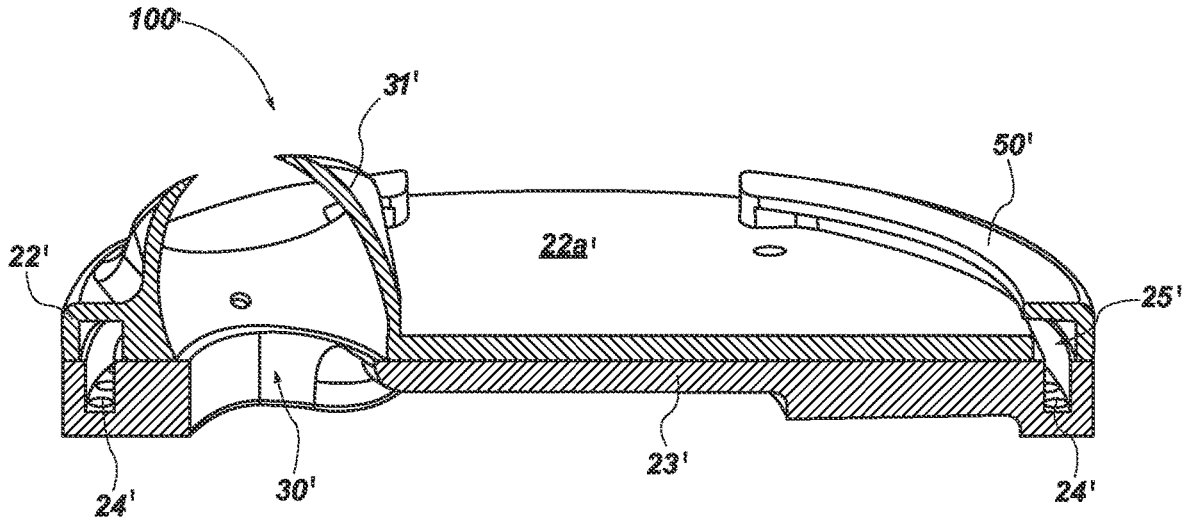

FIGS. 15A-15B illustrate front cross-sectional views of the vacuum shroud 20'. As illustrated, the vacuum shroud 20' includes the top piece 22' secured to the bottom piece 23', the vacuum attachment void 30', and the wall 31' of the vacuum attachment void 30' extending upward from the top piece 22'. In some embodiments, the wall 31 and the vacuum attachment void 30 extend through the shroud body 21 at an angle that is less than about 90°, such as 25°, 30°, 40°, 45°, 50°, 60°, 70°, 75°, 80°, or an angle within a range defined by any two of the foregoing values. The angle of the wall 31 is less than about 90° to position the vacuum hose 10 at an angle of less than about 90° as the hose 10 exits the vacuum attachment void 30.

Positioning the vacuum hose 10 at an angle of less than about 90° improves the overall suctioning capacity and efficiency of the vacuum system 100 as a flow of suctioned air (and dust and debris contained within the suctioned air) is not required to make a sharp 90° turn in order to exit the system 100 and into a vacuum bag. In some embodiments, positioning the vacuum hose 10 at an angle of less than about 90°, or having a vacuum hose with an angle of less than about 90°, improves the overall suctioning capacity and efficiency of the vacuum system 100 by about 25%, such as 15%, 20%, 30%, 35%, or a percentage within a range defined by any two of the foregoing values. In some embodiments, positioning the vacuum hose 10 at an angle of less than about 90°, or having a vacuum hose with an angle of less than about 90°, improves the longevity of the system and the vacuum hose. For example, an angle of less than about 900 can reduce forceful impacts by dust and debris against the inside of the vacuum hose.

Also illustrated is the extension 50' and the slot 25' defined by the extension 50' and/or the top piece 22'. In some embodiments, the extension 50' is a continuous upward projection of the top piece 22'; in other embodiments, the extension 50' may be additionally piece secured to the edges of the top piece 22' (e.g., circumferential edge 22*c*').

In some embodiments, the slot 25' of the top piece 22' is substantially aligned with the slot 25*b*' of the bottom piece 23' such that a substantially consistent channel is created. At the bottom of this channel are the plurality of air holes 24'. Again, positioning of the plurality of air holes 24' within the slot 25*b*' of the bottom piece 23', and covering the plurality of air holes 24' via the slot 25' and the extension 50' of the top piece 22', protects the plurality of air holes 24' and maintains a suction force of the overall system 100'.

Figure 16:
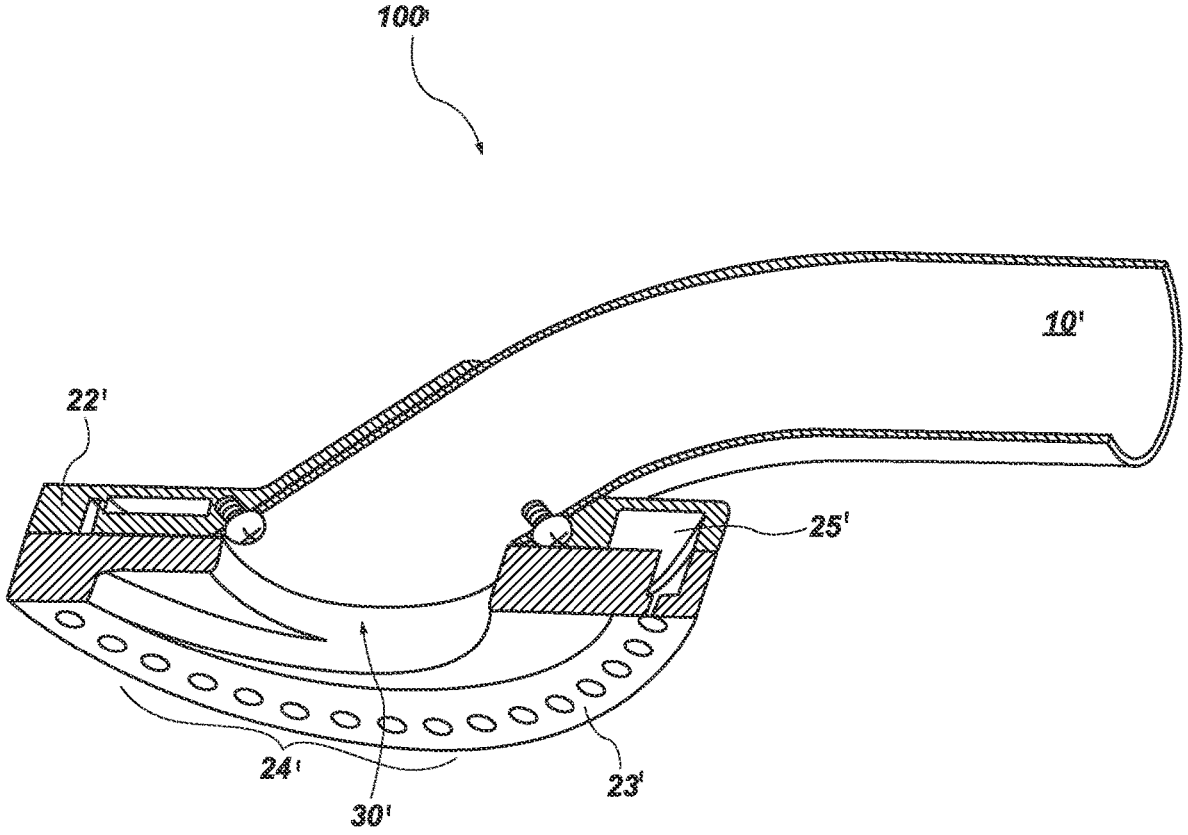
FIG. 16 illustrates a side cross-sectional view of the vacuum shroud body from the vacuum shroud system of FIGS. 10A-10C.

FIG. 16 illustrates a side cross-sectional view of the vacuum portion of the vacuum shroud system 100'. The vacuum hose 10' is illustrated disposed within the vacuum attachment void 30' adjacent the vacuum wall 31' and extending at an angle out of the vacuum attachment void 30' (and, for example, out of the tunnel created by the wall 31' shown in FIGS. 12A and 15A-15B). Specifically, the vacuum hose 10' extends and exits the vacuum attachment void 30' at an angle of less than about 90°, thereby improving the suction capacity as discussed elsewhere. The vacuum hose 10' is disposed within the void 30' and held in place by one or more screws or fasteners. The vacuum hose 10' may be in fluid communication with the void 30' in any suitable manner. In one embodiment, the vacuum hose is detachable from the shroud and in other embodiments the vacuum hose may be non-detachable.

Figure 17A:
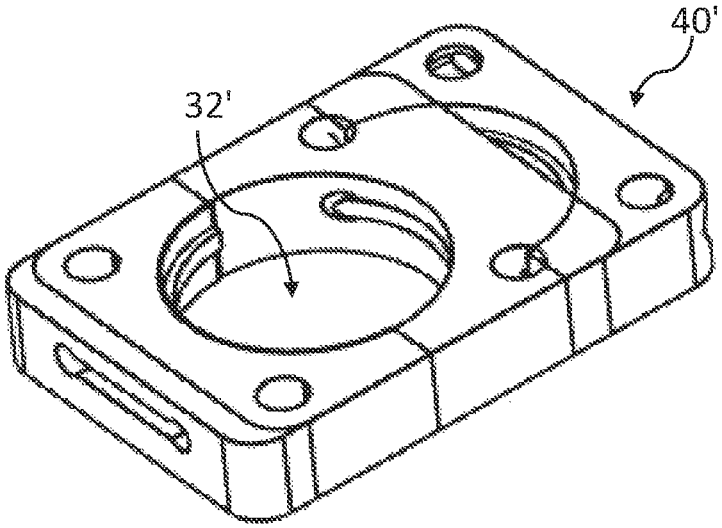
FIGS. 17A-17C illustrate perspective views of another embodiment of an adjustable collar for attaching a grinder to a vacuum shroud system, such as the vacuum shroud system of FIGS. 10A-10C.
Figure 17B:
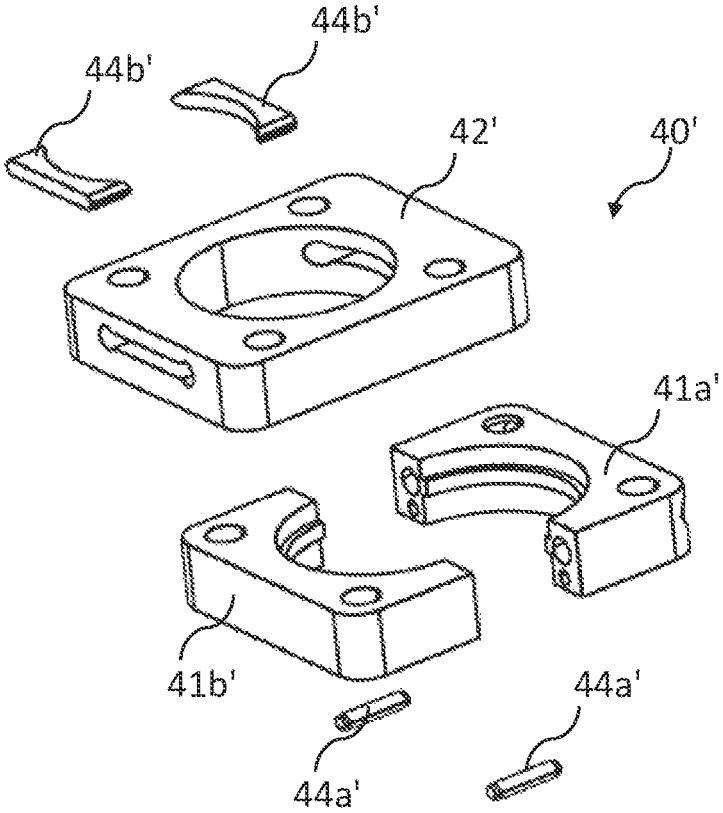
Figure 17C:
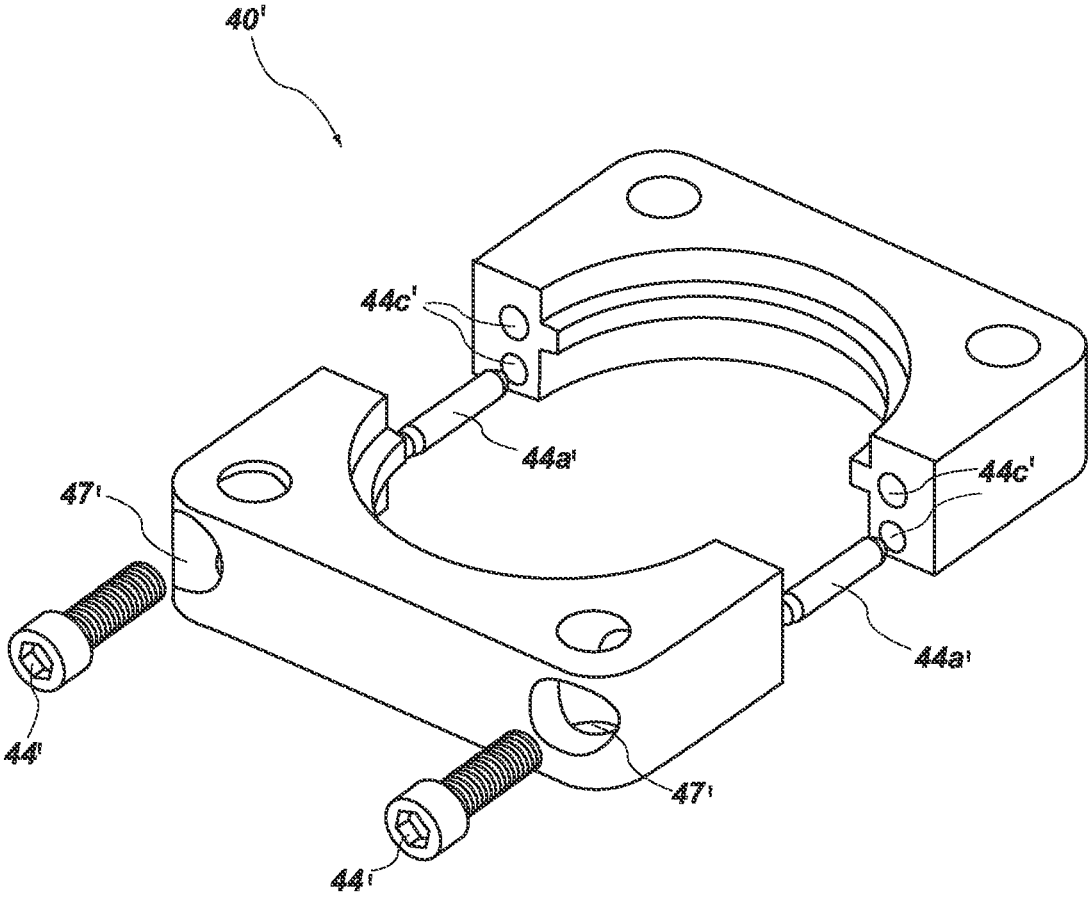

FIGS. 17A-17C illustrate perspective views of another embodiment of an adjustable collar 40' for attaching a grinder to a vacuum shroud system 100', such as the vacuum shroud system 100' of FIGS. 10A-10C. Similar to the adjustable collar 40 of FIGS. 9A-9B, the adjustable collar 40' defines an opening, which may correspond to the grinder attachment void 32'. Also similarly, the adjustable collar 40' includes a first half 41' and a second half 42' joinable, securable, and/or connectable to the first half 41'. When the first half 41' and the second half 42' are in a fastened configuration, they define the grinder attachment void 32' or a portion of the void 32' (the top surface 22*a'* may define another portion of the grinder attachment void 32').

In some embodiments, such as illustrated, the first half 41' includes a first portion 41*a'* and a second portion 41*b'*, which may substantially be mirror images of each other. The first portion 41*a'* may be securable to the second portion 41*b'* through one or more dowels 44*a'* to form the first half 41'. A size of the grinder attachment void 32' is adjustable based on (i) a position or configuration of the first half 41' and the second half 42', and/or (ii) a position of the first portion 41*a'* and the second portion 41*b'*.

For example, as illustrated in FIG. 17C, the first portion 41*a'* and the second portion 41*b'* may define one or more holes 44*c'* for receiving one or more dowels 44*a'*. Additionally, the first and second portions 41*a'*, 41*b'* may define one or more holes 47' for receiving one or more fasteners 44'. Likewise, though not illustrated, the second half 42' may define one or more holes for receiving one or more fasteners 44' to join or secure the second half 42' to the first half 41'. A position of the one or more fasteners 44' in and through the first half 41' and/or the second half 42' may determine or correspond to the size of the grinder attachment void 32'.

The adjustable collar 40' may be a universal collar. Specifically, the adjustable collar 40' may be sized and shaped to accommodate any size, shape, and/or brand of grinder. For example, the size of the grinder attachment void 32' may be adjusted to accommodate a specific size and/or brand of grinder. The size of the void 32' may be adjusted based on (i) a size of the first half 41' and/or the second half 42' and/or (ii) a position of the fasteners within the one or more holes 41*c*. Similarly, a shape of the void 32' may be adjusted based on (i) a shape of the first half 41' and/or the second half 42' and/or (ii) a position of the fasteners 44' within the one or more holes 47'. In this way, the adjustable collar 40 may universally attach a grinder to the shroud 20.

Further, the universal nature of the adjustable collar 40 may result in a modular vacuum shroud system 100. The adjustable collar 40 may be removed from a first shroud body 21 and attached to a second, different shroud body 21. The differences between the first and second shroud bodies 21 may be in size, shape, type of grinder, type of attachment, etc. The adjustable collar 40 may allow for a dynamic and modular vacuum shroud system 100.

In one embodiment, a vacuum shroud comprises: a shroud body having a top piece and a bottom piece secured to the top piece, a bottom surface of the bottom piece having a bottom circumferential edge, a first recess, and a second recess within the first recess; and a plurality of air holes defined by the bottom piece, the plurality of air holes being (i) disposed about the bottom circumferential edge and (ii) disposed within a channel defined by the bottom piece, wherein the top piece of the shroud body comprises an overhang extending from a top circumferential edge toward a middle of the shroud body, the overhang defining a slot in substantial alignment with the channel defined by the bottom piece such that the plurality of air holes are protected from dust and debris by the overhang of the top piece, wherein air enters the vacuum shroud through the slot defined by the overhang, flows through the plurality of air holes, and exits the plurality of air holes from the bottom surface of the bottom piece, and wherein there are no air holes or openings on external surfaces of the shroud body.

The vacuum shroud can further comprise a vacuum attachment void defined by the shroud body and extending from the top piece through the bottom piece to the bottom surface. The vacuum shroud can further comprise a grinder attachment void defined by the bottom piece of the shroud body. The vacuum shroud can further comprise an adjustable collar mountable to a top surface of the top side of the shroud over the grinder attachment void, the adjustable collar for receiving and connecting a grinder to the vacuum shroud. The vacuum shroud can have a shroud body that comprises a flat front edge allowing the shroud body to come into contact with a wall or vertically planar surface during a grinding operation.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It should also be noted that some of the embodiments disclosed herein may have been disclosed in relation to a particular grinding process (e.g., tile grinding); however, other processes and grinders (e.g., cement grinding, metal grinding, angle grinders, floor grinders, etc.) are also contemplated.

In one embodiment, the terms "about" and "approximately" refer to numerical parameters within 10% of the indicated range. The terms "a," "an," "the," and similar referents used in the context of describing the embodiments of the present disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments are described herein, including the best mode known to the author(s) of this disclosure for carrying out the embodiments disclosed herein. Of course, variations on these described embodiments will become apparent to those of ordinary skill in the art upon reading the foregoing description. The author(s) expects skilled artisans to employ such variations as appropriate, and the author(s) intends for the embodiments of the present disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of this disclosure so claimed are inherently or expressly described and enabled herein.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A vacuum shroud system for attachment to a grinder comprising:

a shroud body having a top surface and a bottom surface, the shroud body comprising:

a plurality of air inlet holes defined by the shroud body and extending from the top surface to the bottom surface, the plurality of air inlet holes for directing air from the top surface to the bottom surface, a cover securable to the top surface of the shroud body, the cover overhanging the plurality of air inlet holes at the top surface to protect the plurality of air inlet holes from debris a vacuum attachment void defined by the shroud body and extending from the top surface to the bottom surface, and a grinder attachment void defined by the shroud body and extending from the top surface to the bottom surface;

an adjustable collar comprising a first half and a second half connectable to the first half, the adjustable collar disposed over the grinder attachment void of the shroud body;

a vacuum hose securable within the vacuum attachment void, a wall of the vacuum attachment void determining an outlet angle for the vacuum hose.

2. The vacuum shroud system of claim 1, wherein the size of the adjustable collar is adjusted via a position of a plurality of fasteners, the plurality of fasteners connecting the first half and the second half together.

3. The vacuum shroud system of claim 1, wherein the shroud body further comprises a top circumferential edge and the top surface of the shroud body is recessed from the top circumferential edge.

4. The vacuum shroud system of claim 1, wherein the top surface of the shroud body comprises a top circumferential edge and a shelf to receive the cover.

5. The vacuum shroud system of claim 4, wherein the top circumferential edge extends proximally beyond the top surface of the shroud body.

6. The vacuum shroud system of claim 5, wherein the plurality of air holes extend from the shelf to a bottom circumferential edge of the bottom surface of the shroud body.

7. An adjustable collar for connecting a grinder to a vacuum shroud, the adjustable collar comprising:

a first half comprising a base and a projection extending from the base, the projection defining a first plurality of holes to receive a plurality of fasteners;

a second half connectable to the projection of the first half, the second half defining a second plurality of holes to receive the plurality of fasteners; and a grinder attachment void for receiving the grinder and connecting the grinder to the vacuum shroud, the grinder attachment void defined between the projection of the first half and the second half when the projection and the second half are in a fastened configuration, wherein a size of the grinder attachment void is adjustable through a position of the plurality of fasteners in the fastened configuration, and wherein the second half rests on the base of the first half in the fastened configuration.

8. A method of using a vacuum dust shroud, the method comprising:

providing a vacuum shroud comprising:

a shroud body comprising a top piece and a bottom piece secured to the top piece, the top piece defining a void for receiving an adjustable collar, a plurality of inwardly positioned air holes defined by the shroud body and protected by a cover attached to the shroud body, a vacuum attachment void defined by the shroud body and extending at an angle of less than 90° from a top surface to a bottom surface of the shroud body, and a grinder attachment void defined by the shroud body and extending from the top surface to the bottom surface of the shroud body;

attaching a vacuum hose to vacuum attachment void of the vacuum shroud, the vacuum hose exiting the vacuum attachment void at the angle of less than 90°;

attaching a grinder to the grinder attachment void of the vacuum shroud via an adjustable collar; and suctioning air, dust, and debris developed during a grinding process into a vacuum bag through the vacuum hose, wherein the plurality of inwardly positioned air holes are protected from the developed dust and debris by the cover, and wherein the air, dust, and debris flow are suctioned through the vacuum hose at the angle of less than 90°.

* * * * *